US009339164B2

(12) United States Patent
Santarsiero et al.

(10) Patent No.: US 9,339,164 B2
(45) Date of Patent: May 17, 2016

(54) CLEANUP SYSTEM

(71) Applicants: Paul Santarsiero, Avon, CT (US); Roger Comora, Jacksonville, FL (US)

(72) Inventors: Paul Santarsiero, Avon, CT (US); Roger Comora, Jacksonville, FL (US)

( * ) Notice: Subject to any disclaimer, the term of this patent is extended or adjusted under 35 U.S.C. 154(b) by 519 days.

(21) Appl. No.: 13/815,530

(22) Filed: Mar. 8, 2013

(65) Prior Publication Data

US 2013/0269129 A1 Oct. 17, 2013

Related U.S. Application Data

(63) Continuation-in-part of application No. 13/134,588, filed on Jun. 10, 2011, now Pat. No. 8,904,589.

(51) Int. Cl.

| | |
|---|---|
| ***A47L 13/52*** | (2006.01) |
| ***A47L 13/12*** | (2006.01) |
| ***A47L 13/11*** | (2006.01) |
| ***A47L 5/36*** | (2006.01) |
| ***A47L 9/24*** | (2006.01) |
| ***A46B 15/00*** | (2006.01) |

(52) U.S. Cl.

CPC ..... *A47L 13/12* (2013.01); *A46B 15/0081* (2013.01); *A47L 5/36* (2013.01); *A47L 9/24* (2013.01); *A47L 13/11* (2013.01); *A47L 13/52* (2013.01)

(58) Field of Classification Search

CPC ..... A47L 13/52
USPC ..... 15/257.1–257.9
See application file for complete search history.

(56) References Cited

U.S. PATENT DOCUMENTS

| | | | | |
|---|---|---|---|---|
| 346,761 | A | | 8/1886 | Marsh et al. |
| 389,366 | A | | 9/1888 | Cunningham |
| 492,373 | A | | 2/1893 | Minor |
| 715,756 | A | | 12/1902 | Clover |
| 720,761 | A | | 2/1903 | Wade |
| 772,093 | A | | 10/1904 | Forden |
| 834,770 | A | | 10/1906 | Steele |
| 1,255,902 | A | | 2/1918 | Marriott |
| 2,176,135 | A | | 10/1939 | Horst |
| 2,879,530 | A | | 3/1959 | Ego |
| 2,999,259 | A | | 9/1961 | Sheldon |
| 3,002,209 | A | | 10/1961 | McKinstry |
| 3,056,993 | A | | 10/1962 | Lewisd |
| 3,220,042 | A | | 11/1965 | Harrington |
| 3,382,523 | A | * | 5/1968 | Parsisson ..... A47L 13/52 15/257.2 |
| 4,148,513 | A | | 4/1979 | Gagne |
| 4,360,947 | A | | 11/1982 | DeCosa et al. |
| 4,705,310 | A | | 11/1987 | Scripter |
| 4,741,566 | A | | 5/1988 | Byung-Do et al. |
| 4,882,794 | A | | 11/1989 | Stewart, III |
| 5,012,542 | A | | 5/1991 | Lynn |
| 5,437,078 | A | | 8/1995 | Courcelles |
| 5,836,045 | A | | 11/1998 | Anthony et al. |
| 5,974,624 | A | | 11/1999 | Eisen |
| D441,933 | S | | 5/2001 | Savage et al. |

(Continued)

FOREIGN PATENT DOCUMENTS

| | | |
|---|---|---|
| GB | 1021750 | 3/1966 |

*Primary Examiner* — Monica Carter
*Assistant Examiner* — Stephanie Berry
(74) *Attorney, Agent, or Firm* — Ira S. Dorman

(57) ABSTRACT

The cleanup system employs an associated clearing component, such as a tool comprised of plate portion and an adjacent squeegee and/or brush element, to close the top opening and entrance to a containment or receptacle unit with which it is pivotably interengageable, to thereby prevent leakage or escape of liquid, semi-liquid, and/or dry matter during transport.

18 Claims, 30 Drawing Sheets

(56) References Cited

U.S. PATENT DOCUMENTS

| | | | | |
|---|---|---|---|---|
| 6,250,831 | B1 | 6/2001 | Craven | |
| D462,259 | S | 9/2002 | Williams | |
| 6,477,733 | B1 | 11/2002 | Kuhns | |
| 7,404,229 | B2 | 7/2008 | Monahan et al. | |
| D636,548 | S * | 4/2011 | Hoover | D32/49 |
| 2003/0167588 | A1 | 9/2003 | Perelli et al. | |
| 2007/0089259 | A1 | 4/2007 | Jones | |
| 2009/0223007 | A1 | 9/2009 | Li | |

* cited by examiner

10'
33
40

33
10'
40

33
40'
45
41
10'
49

33
40
10
15
17'
10'
44'
17'
43
10

43
47
41
43
47
45

14
10
44'
26
28
46
49
B

33'
64
67
63
52
60
66
65
50
54
62
16'
38
40'
45'
34
58
56
16

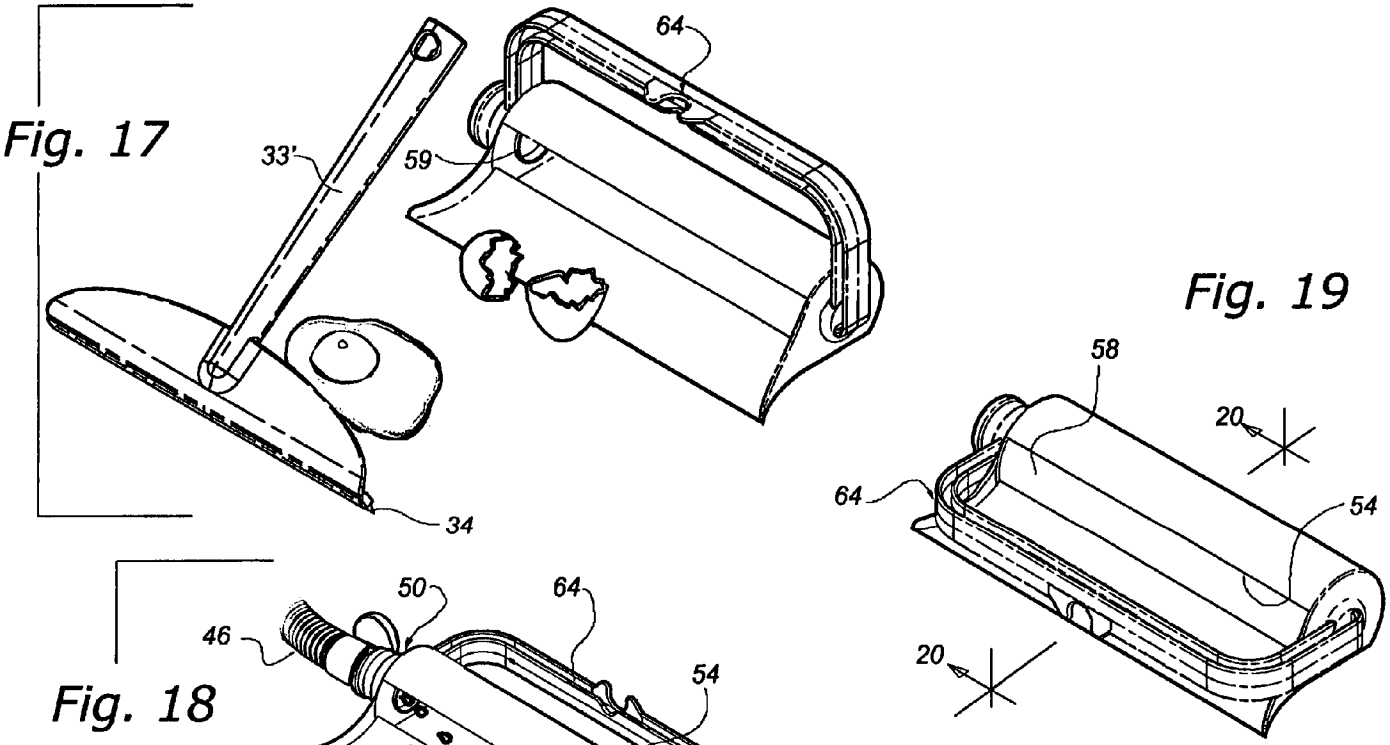
Fig. 17
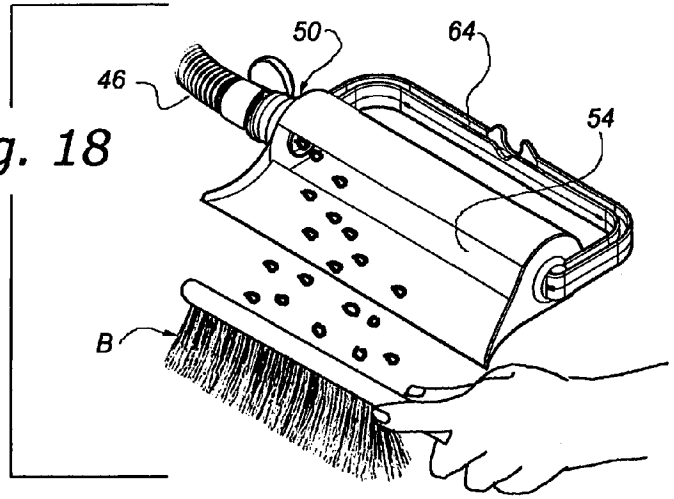
Fig. 18
Fig. 19

64'
90
96
50'

90
98
97
64

50'
64'

90
61'
64'
97
50'

98
64'
99
50'
96
92
97
90
99
94

116
114
118
123
122
120
132
124
130
126
128

148
147
146
140'
141
152
156
160
162
158

148
147
146
140'
142'
141
162
158
154
152
156

334'
352
330"
314"
310"

70
310"
330"
334'
70

352'
334'
314"
356
358

358
334'
352'
314"
354
356
310"

334'
350
352
354
310"
316'

330"
338"
350
340"
334'
352
323"
315"
314"
312"
310"
354
316

CLEANUP SYSTEM

CROSS-REFERENCE TO RELATED APPLICATIONS

This application is a continuation-in-part of copending U.S. patent application Ser. No. 13/134,588, filed Jun. 10, 2011, which claims the benefit of U.S. Provisional Patent Application No. 61/397,510, entitled CLEANUP SYSTEM and filed, in the names of the inventors hereof, on Jun. 11, 2010.

BACKGROUND OF THE INVENTION

Numerous devices and systems are known in the art, and are commercially available, for use in effecting the physical removal of solid and liquid substances from surfaces. Such a system might, in rudimentary form, simply comprise a dustpan and a broom, or a squeegee and a cooperating receptacle unit. The following patent documents are representative of prior art that may be germane to the present invention:

| |
|---|
| U.S. Pat. No. 346,761 |
| U.S. Pat. No. 389,366 |
| U.S. Pat. No. 492,373 |
| U.S. Pat. No. 715,756 |
| U.S. Pat. No. 720,761 |
| U.S. Pat. No. 772,093 |
| U.S. Pat. No. 834,770 |
| U.S. Pat. No. 1,255,902 |
| U.S. Pat. No. 2,176,135 |
| U.S. Pat. No. 2,879,530 |
| U.S. Pat. No. 2,999,259 |
| U.S. Pat. No. 3,002,209 |
| U.S. Pat. No. 3,056,993 |
| U.S. Pat. No. 3,220,042 |
| U.S. Pat. No. 3,382,523 |
| U.S. Pat. No. 4,148,513 |
| U.S. Pat. No. 4,360,947 |
| U.S. Pat. No. 4,705,310 |
| U.S. Pat. No. 4,741,566 |
| U.S. Pat. No. 4,882,794 |
| U.S. Pat. No. 5,012,542 |
| U.S. Pat. No. 5,437,078 |
| U.S. Pat. No. 5,836,045 |
| U.S. Pat. No. 5,974,624 |
| U.S. Pat. No. 6,250,831 |
| U.S. Pat. No. 6,477,733 |
| U.S. Pat. No. 7,404,229 |
| U.S. Pat. No. D441,933 |
| U.S. Pat. No. D462,529 |
| U.S. Patent Pub. No. 2003/0167588 |
| U.S. Patent Pub. No. 2007/0089259 |
| U.S. Patent Pub. No. 2008/0092321 |
| U.S. Patent Pub. No. 2009/0223007 |
| GB Patent Spec. No. 1,020,750 |

Despite the level of activity indicated by the foregoing, a need exists for a system by which dry, liquid, or semi-liquid (wet) matter can readily be moved into a receptacle and maintained therein against escape, undue leakage, or spillage, such as during transport to a disposal location.

BRIEF SUMMARY OF THE INVENTION

It is a broad object of the present invention to provide a cleanup system with which liquid, semi-liquid, and/or dry matter can readily be moved from a surface into a receptacle and maintained therein without escape, undue leakage, or spillage.

More specific objects of the invention are to provide such a cleanup system in which a clearing component (e.g., a squeegee tool) is engageable with a cooperating receptacle component for closing the access opening through which the removed matter passes into a chamber of the receptacle, as well as a top opening, so as to prevent such escape, leakage, or spillage and, in preferred embodiments, for effectively sealing the openings.

Additional objects of the invention are to provide a system having the foregoing features and advantages, which system is of relatively incomplex and inexpensive construction, is easy and convenient to use and store, and is highly effective for its intended purposes.

It has now been found that certain of the foregoing and related objects of the invention are readily attained by the provision of a cleanup system comprised of a containment unit and a separate clearing component, the containment unit having a chamber for containing matter, handle structure disposed rearwardly of the chamber, and structure defining a top opening into the chamber and a contiguous front entrance to the chamber. The clearing component includes closure structure comprised of at least one forward marginal portion extending laterally, from side-to-side on the clearing component and having a surface-clearing element thereon and a plate portion extending rearwardly from the marginal portion, and handle structure disposed rearwardly of the plate portion and being dimensioned and configured to mate with the handle structure of the containment unit. The containment unit and the clearing component have means thereon for securing the containment unit and the clearing component in an interengaged, closed relationship in which the closure structure of the clearing component overlies the top opening and the front entrance of the containment unit, the closure structure being dimensioned and configured to close the top opening and the entrance, in the overlying position, against the substantial escape of matter therethrough from the interior chamber. The means for securing comprises pivotably interengageable elements forwardly disposed on the containment unit and the clearing component and permitting pivotal movement of the clearing component to the closed relationship. Fixedly interengageable elements rearwardly disposed on the containment unit and the clearing component disengageably maintain the containment unit and the clearing component in the closed relationship.

Normally, the forwardly disposed pivotably interengageable elements comprising said means for securing will comprise two laterally-spaced and aligned recess-defining structures and two laterally spaced and aligned insert elements, with the recesses defined by the recess-defining structures being dimensioned and configured for pivotably receiving said insert elements therein. More particularly, the containment unit will include an upstanding wall defining the top opening, the plate portion of the clearing component will have a peripheral marginal portion thereon extending generally rearwardly from adjacent the at least one forward marginal portion, and the pivotably interengageable elements will be disposed on the upstanding wall and on or proximate the forward marginal portion. The recesses defined by the two recess-defining structures may open forwardly (taken in the direction of normal use of the system), to receive the insert elements inserted in the rearward direction, or they may open rearwardly, to receive the insert elements inserted in the forward direction.

Alternatively, the forwardly disposed pivotably interengageable elements comprising the means for securing may comprise a laterally extending edge element and structure defining at least one laterally extending groove, the groove being dimensioned and configured for pivotably receiving the laterally extending edge element. In such embodiments in which the containment unit includes ramp structure leading to the chamber thereof, and in which the clearing component additionally includes a squeegee member extending along the forward marginal portion, the pivotably interengageable elements will desirably be disposed on the ramp structure and the squeegee member.

In preferred embodiments, at least one gasket element (which may comprise an element of a squeegee member) will be interposed between surfaces on the containment unit and the clearing component that mate in the closed relationship of the closure structure of the clearing component and the containment unit. The handle structures of the containment unit and the clearing component will usually extend rearwardly, and the fixedly interengageable elements will desirably comprise coacting detent elements disposed adjacent forward ends of the handle structures.

In certain embodiments of the invention, the clearing component will include a squeegee member that has generally triangular matter-confinement flaps joined to and depending from its lateral edges and extending to its leading edge. A free, surface-engaging lower edge extends rearwardly from the leading edge of each matter-confinement flap, and the flap is pleated along at least one line extending rearwardly from the leading edge of the squeegee member and intermediate the lower edge of the flap and the joined lateral edge of the squeegee member. The matter-confinement flaps are constructed to fold inwardly, naturally and resiliently on the pleat in response to force effectively applied upwardly to the lower edge thereof, and will articulate and maintain a constant contact and pressure against a planar surface during the natural sweeping movement that is caused by the normal motion of a user's arm. Thus, the clearing tool will assume various angles in response to the way in which the human arm and hand move in effecting a pulling action, across a given surface, and the matter-containment flaps will flex to accommodate the angular changes.

BRIEF DESCRIPTION OF THE SEVERAL VIEWS OF THE DRAWINGS

FIG. 17 is a perspective view, similar to FIG. 13, showing a slightly modified form of the containment unit in which the door is in open position when the handle is disposed vertically, the system, as shown, being employed for the removal of semi-liquid matter;

FIG. 18 is a view similar to FIG. 17, showing the containment unit with its door open in a second orientation of the handle, showing connection to a vacuum system hose, and being employed for the receipt of solid matter swept thereinto using a separate brush;

FIG. 19 is a perspective view of the containment unit of FIGS. 17 and 18, showing the door in its closed position with the handle pivoted to a generally horizontal, forward orientation;

DETAILED DESCRIPTION OF THE INVENTION

Figure 3C:
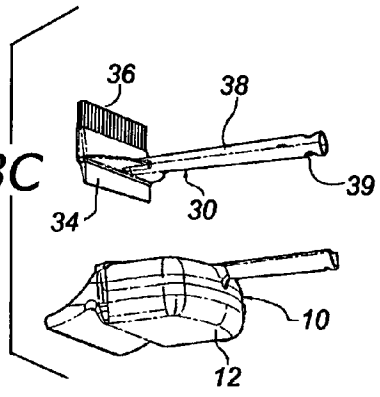
FIGS. 3A, 3B, 3C, and 3D are exploded perspective views of the system of FIGS. 1 and 2, drawn to a reduced scale and taken from various perspectives.
Figure 3D:
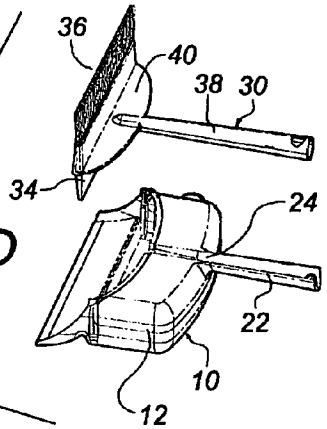

It will be appreciated that, where common reference numbers are employed in the several embodiments described and illustrated in this specification, the elements referenced are the same or similar throughout. Similarly, where primed reference numbers are employed the components are similar to components referenced by the same unprimed number.

Turning initially to FIGS. 61 through 64 of the drawings, therein illustrated is a first embodiment of the cleanup system of the invention and consisting of a containment unit, generally designated by the numeral 310, and a clearing tool generally designated by the numeral 330. The containment unit comprises a body 312 that defines an interior chamber 314 to the front of which an inclined ramp 316 leads; low lateral wall elements 318 extend along the sides of the ramp 316, to confine and help direct matter being moved into the chamber 314, and a flexible lip element 320 extends across its forward edge. A front wall section 321, that is generally vertical in normal use, joins the ramp 316 to the bottom wall 313 of the containment unit body 312, from which a handle 322 of hollow, generally semicircular cross section extends rearwardly.

Figure 64:
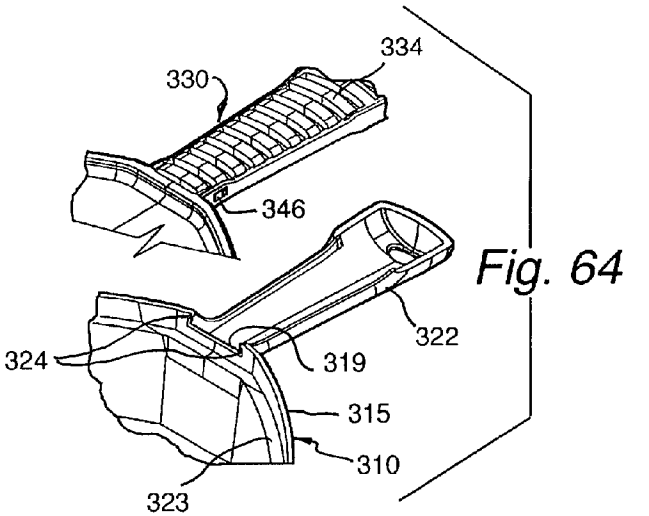
FIG. 64 is a fragmentary perspective view of portions of the components of the system of the foregoing figures, drawn to an enlarged scale to better show cooperating detent elements provided thereon.

As is best seen in FIG. 64, at the intersection of the handle 322 and the body 312 a generally rectangular notch 319 is formed into the upper marginal portion 315 of the sidewall 322 by which the chamber 314 is defined (in cooperation with the bottom and front walls 313, 321); the marginal portion 315 circumscribes the open top of the chamber 314, and terminates in a shoulder 323. The notch 319 is formed with a pair of inwardly directed, opposing finger elements 324 at its upper corners. Forwardly opening, generally V-shaped recesses 317 are formed into the forwardmost opposite ends of the marginal portion 315; the recesses 317 are laterally aligned with one another on opposite sides of the central axis of symmetry that extends through the body 312 and the handle 322 of the containment unit 310. Although the handle will normally lie on a central axis of symmetry through the body 312, it should be noted that it may instead be oriented at an angle (e.g., of 45° to 90°) thereto if so desired. The functions of the notch 319 and the recesses 317 will be described presently.

The clearing tool 330 consists of a forward marginal portion 332 on which are provided a brush and a resilient squeegee member, generally designated by the numerals 334 and 336, respectively; the squeegee member 336 is itself of unique construction, and will be more fully described below with reference to FIGS. 74 through 78. A plate portion 338, having a generally semi-oval or semi-elliptical shape (conforming to the configuration of the containment unit top opening) extends rearwardly from the forward marginal portion 332 and is configured to fit within the upper marginal portion 315 of containment unit 310 and to bear upon the shoulder 323, so as to effectively close the top opening of the chamber 314 when the tool 330 is assembled with the body 312. A raised peripheral marginal portion 340 circumscribes the plate portion 338, and a pair of transversely aligned insert or lug elements 342 project laterally outwardly from the forward ends of the peripheral marginal portion 340. As indicated by the curved arrow in FIG. 61, the lug elements 342 are received in the recesses 317 in the marginal portion 315 of the containment unit 310, as the tool 330 is moved rearwardly into position over the chamber 314, and function as pivot points for pivoting of the clearing tool, under leveraged force, to the fully closed relationship depicted in FIGS. 62 and 63.

The handle 344 of the tool 330 extends rearwardly from the plate portion 338 along the axis of symmetry (center line), and is dimensioned and configured to nest within the hollow handle 322 of the containment unit (needless to say, if the handle 322 is angularly offset from the center line, the handle 344 will be offset as well). As can be seen in FIG. 64, the handle 344 has small recesses 346 formed into its opposite sides (only one of which is visible), which serve to engage the finger elements 324 on the containment unit 310 in a snap-fit action to cooperate with the forwardly disposed pivot elements 317, 342 so as to maintain the components of the system in their assembled relationship, with the tool component 330 closing the top opening of the chamber 314.

Figure 62:
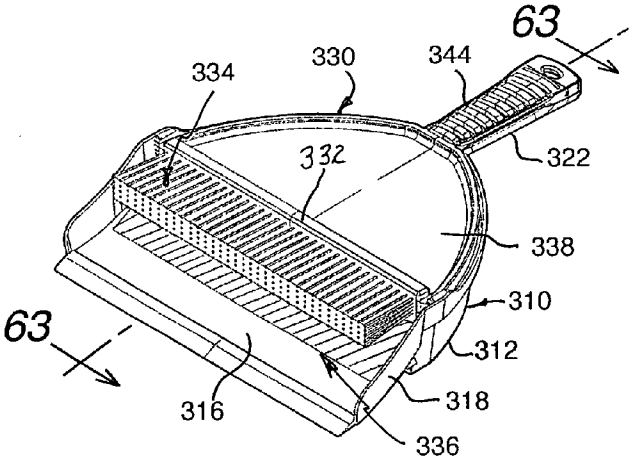
FIG. 62 is a perspective view of the cleanup system of FIG. 61, in which the components are assembled in closed relationship.
Figure 63:
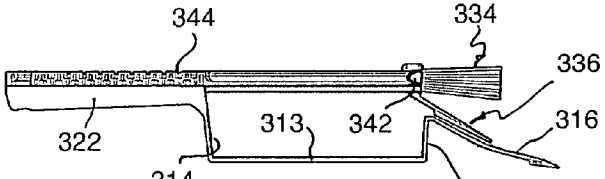
FIG. 63 is a view of the system, in partial section and closed relationship, taken along line 63-63, a center line of symmetry, of FIG. 62.

It will be noted from FIGS. 62 and 63 that, in the closed relationship, the squeegee member 334 is tightly engaged, in a flexed condition, against the inclined ramp 316 of the body 312. Thus, the squeegee member 334 cooperates with the plate portion 338 of the clearing tool 330 to fully seal the entrances (front and top openings) to the chamber 314, both the squeegee member 334 and the peripheral marginal portion 340 acting compressively against their respective mating surfaces due to the forces generated when the clearing tool is finally pivoted to its fully seated position. While an added gasket element or elements will desirably be interposed between mating surfaces of the forward and peripheral marginal portions of the clearing tool and the containment unit body (as will be described more fully below), the components may themselves be so formed as to effectively produce watertight sealing (e.g., through very thin-wall, resiliently-deformable sections, inherent resiliency, etc.), as is unique to the present invention.

Figure 67:
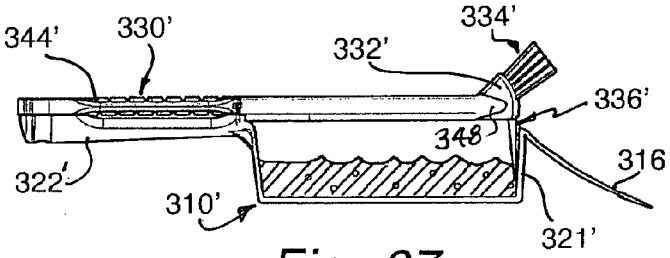
FIG. 67 is a view similar to FIG. 63, taken along line 67-67 in FIG. 66.
Figure 66:
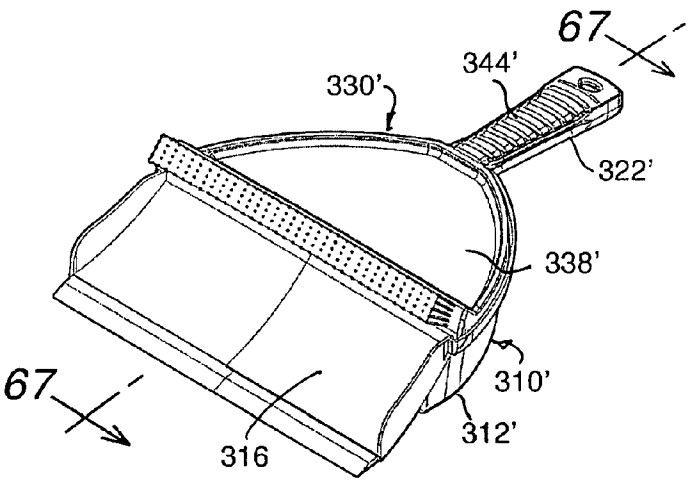
FIG. 66 is a view showing the components of the second embodiment in closed relationship, similar to FIG. 62.
Figure 65:
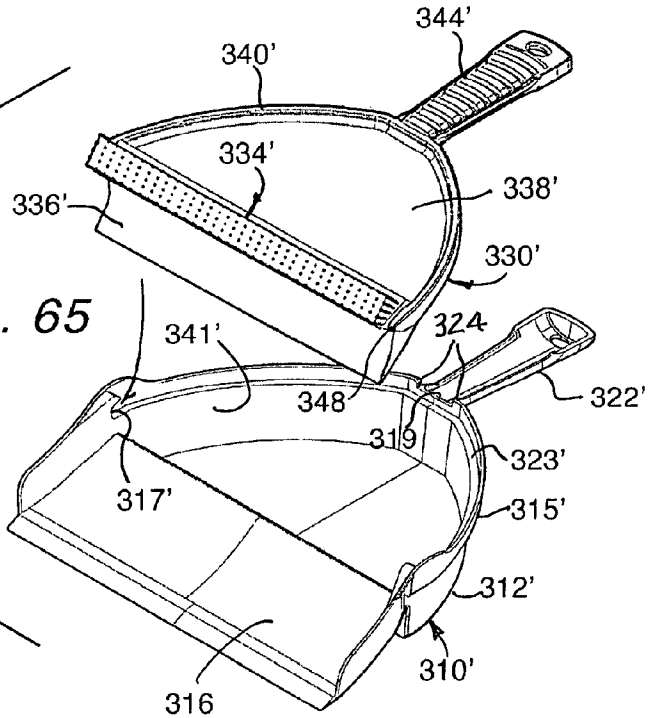
FIG. 65 is an exploded perspective view similar to FIG. 61, showing a second form of cleanup system embodying the present invention.

A second embodiment of the invention is depicted in FIGS. 65 through 67, which is essentially the same as the system of FIGS. 61 through 64. Accordingly, the following description will focus on the distinctions therebetween.

As is best seen in FIG. 65, instead of the forwardly opening V-shaped recesses 317 provided on the body 312 of the containment unit 310 of the foregoing figures, in the present embodiment transversely aligned, rearwardly opening U-shaped recesses 317'(only one of which is visible in FIG. 65) are formed at the forwardmost ends of the upper marginal portion 315' on the body 312' of the containment unit 310'. The clearing tool 330' has a plain squeegee member 336' on its forward marginal portion 332', and the brush 334' is disposed thereon at an angle of about 45° to the planar portion 338 (rather than being coplanar therewith, as in the first embodiment described). The peripheral marginal portion 340' terminates at its forward ends in transversely aligned rounded tips 348, which are pivotably received in the recesses 317' when the clearing tool 330' is moved forwardly into position over the body 312'. Leveraging the tool 330' downwardly into its fully seated position, within the upper marginal portion 315' and against the shoulder 323', will again effectively seal the openings to the containment chamber and produce snap fit interengagement of the finger elements 324 with the tool handle 344' (in accordance with the illustration of FIG. 64).

It will be noted from FIG. 67 that in the closed relationship the squeegee member 336' is disposed tightly, and in a compressed state, against the front wall section 321' of the body 312'. This course serves to seal the chamber entrance at the inner end of the ramp 316.

The third embodiment of the present system, depicted in FIGS. 68 through 73, is again similar to those of FIGS. 61 through 67 but with a primary distinction residing in the provision of structure defining a laterally extending groove 350 in the squeegee member, generally designated by the numeral 352. The groove 350 receives the lip portion 354 that traverses the body 312" at the top of the ramp 316', and thereby defines a pivot fulcrum.

Figures 68, 69, 70, 71, 72, 73:
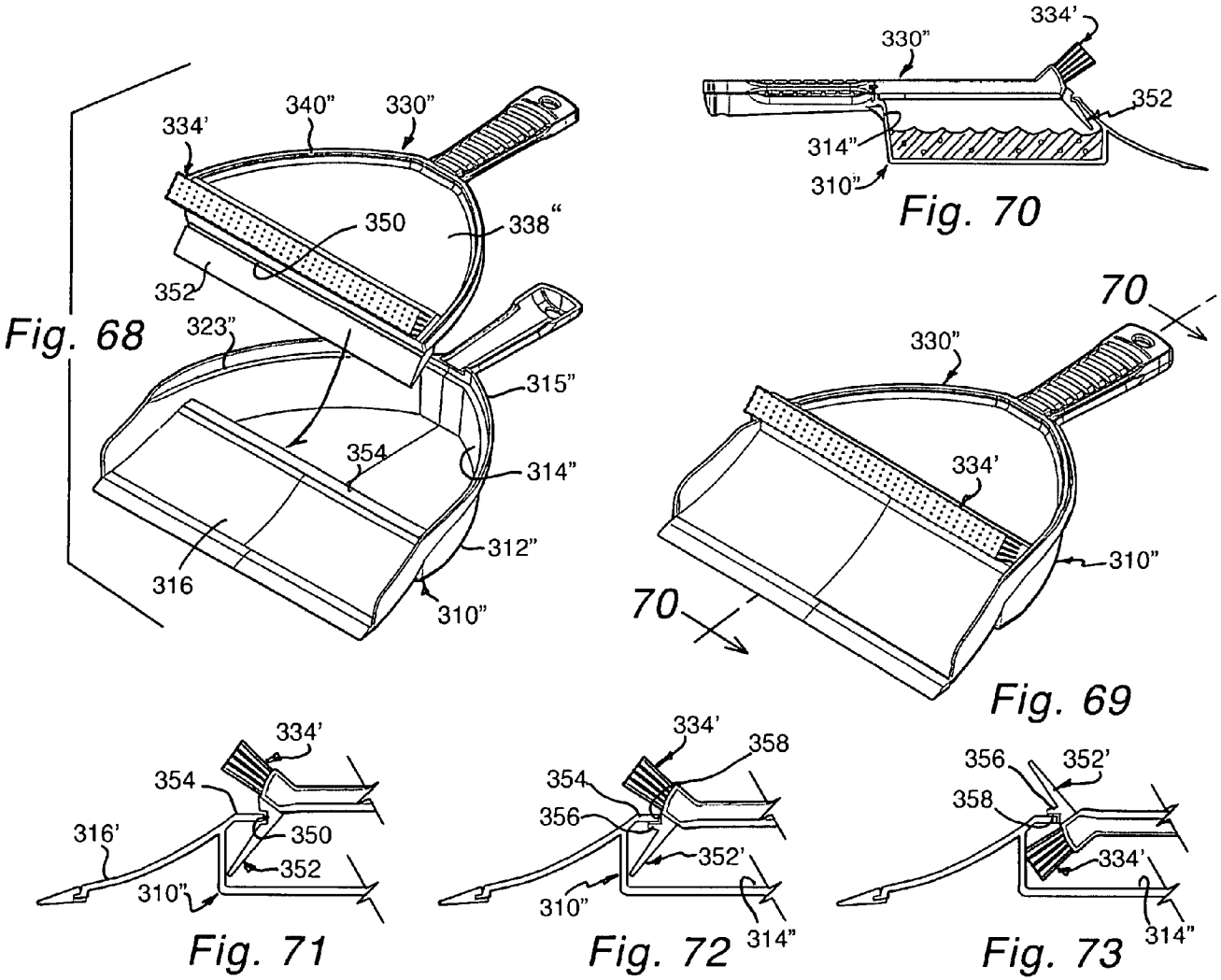
FIG. 68 is an exploded perspective view of a third cleanup system embodying the invention, similar to FIGS. 61 and 65.
FIG. 69 is a view similar to FIGS. 62 and 66, showing the components of the third embodiment assembled in closed relationship.
FIG. 70 is a partial cross-sectional view similar to FIGS. 63 and 67, taken along center line 70-70 in FIG. 69, drawn to a scale reduced therefrom and viewed in the direction of the arrows.
FIG. 71 is a fragmentary cross sectional view, taken along line 70-70 in FIG. 69 but viewed in the direction opposite to the arrows and drawn to an enlarged scale.
FIG. 72 is a view similar to FIG. 71, showing an alternative form of the interengaging pivotal elements.
FIG. 73 is also a view similar to FIG. 71, showing a second alternative form of the interengaging pivotal elements.
Figure 75:
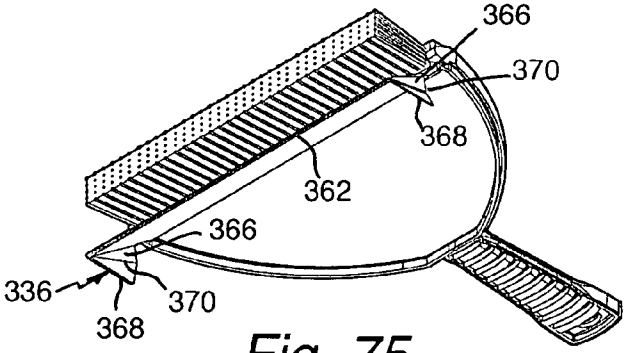
FIG. 75 is a bottom perspective view of the clearing tool depicted in FIG. 74.
Figure 74:
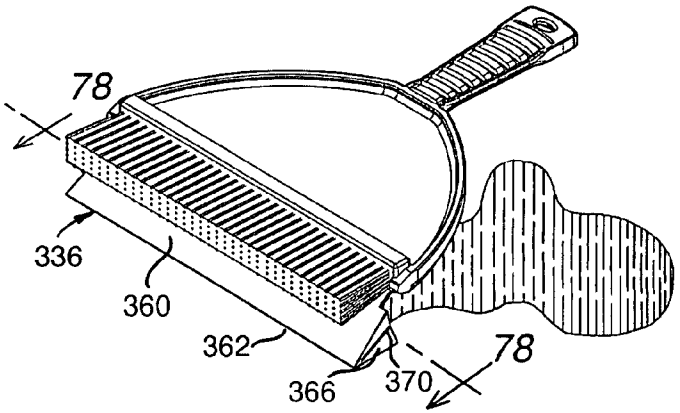
FIG. 74 is a top perspective view of a clearing tool particularly adapted for use in the system depicted in FIGS. 65-67 but incorporating a squeegee element having matter-confinement elements laterally disposed thereon.
Figure 77:
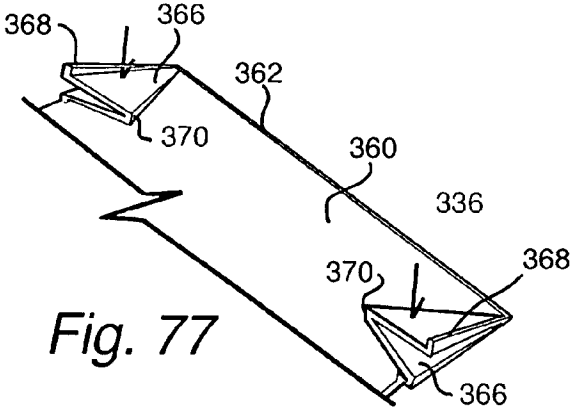
FIG. 77 is a bottom perspective view of squeegee component utilized in the cleanup tool of the foregoing figures, showing the material-confinement end flaps deflected in reaction to force effectively applied in the direction of the arrows.
Figure 78:
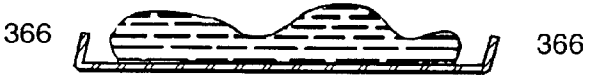
FIG. 78 is a fragmentary cross-sectional view of the squeegee component of the tool of the foregoing figures, taken along line 78-78 in FIG. 74 and showing the component in use for cleaning a liquid substance from a surface.
Figure 76:
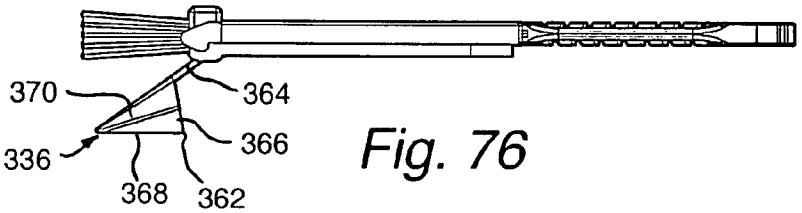
FIG. 76 is a side view of the tool.

As in the embodiment of FIGS. 65 through 67, and as is seen in FIGS. 70 and 71, the squeegee member 352 resides within the chamber 314" of the containment unit body 312", but in this instance the groove 350 cooperates with the lip 354 to seal the front entrance rather than by producing a compressed relationship against the front wall section 321". In addition, the peripheral marginal portion 340" circumscribing the plate portion 338" bears through its full extent upon the shoulder 323" and the upper marginal portion 315".

The embodiment shown in FIGS. 72 and 73 is very similar to that of FIGS. 68 through 70, with the exception that a shelf element 356 defines a laterally extending recess 358 on the squeegee member 352' in which the lip portion 354 resides and engages. Moreover, these figures illustrate, respectively, that the clearing tool 330" can be assembled in closing relationship with the containment unit 310" with either the squeegee member 352' or the brush 334' disposed within the chamber 314" (the other clearing element being of course exteriorly presented).

Figure 61:
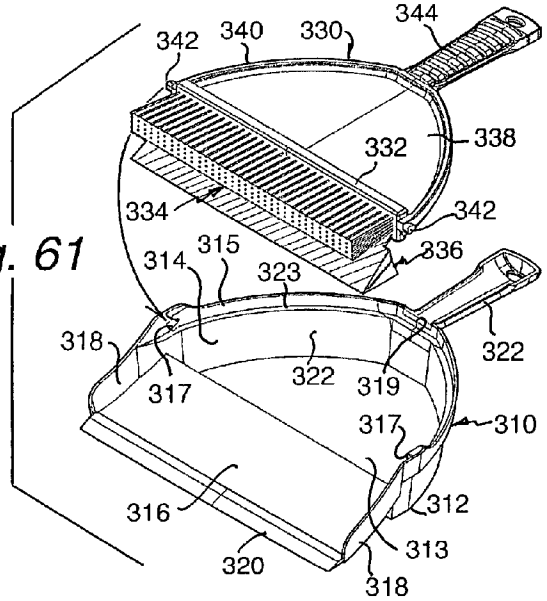
FIG. 61 is an exploded perspective view of a first form of cleanup systems embodying the invention.

FIGS. 74 through 77 illustrate, in greater detail, the squeegee member 336 employed in the clearing tool 330, shown in FIGS. 61 through 63, albeit in the present figures the tool incorporates pivot element of the form provided on tool 330' (FIGS. 65 through 67). The squeegee member 336 consists, more specifically, of a generally rectangular blade portion 360, having a surface-engaging leading edge 362 and opposite lateral edges 364. A generally triangular, substance-confinement flap 366 is joined to each lateral edge 364 and depends therefrom (with the squeegee tool in a horizontal orientation) to a surface-engaging lower edge 368. The flaps 336 are pleated along an intermediate permanent crease line 370 that extends rearwardly from the leading edge 362 of the blade portion. The flaps 336 are formed so as fold inwardly naturally, along the crease line 370, when force is applied in an effectively upward direction (usually produced in reaction to downward force on the clearing tool), as indicated by the arrows in FIG. 77 (the squeegee member being depicted therein in an upside down orientation). As can be seen, especially in FIG. 78, the flaps 366 function to confine the matter being cleared against escape at the opposite ends of the squeegee blade portion 360.

Figure 81:
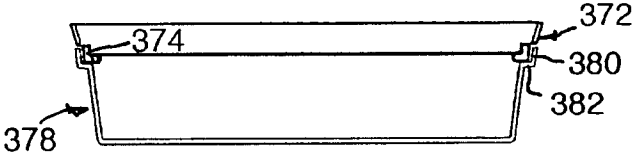
FIG. 81 is a cross-sectional view taken along line 81-81 of FIG. 80.
Figure 80:
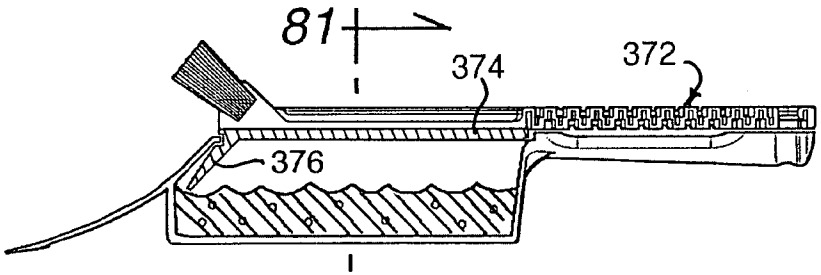
FIG. 80 is a cross-sectional view, taken along a center line, of a clean-up system embodying the invention, in which the clearing tool of FIG. 79 is employed in assembly with a containment unit.
Figure 79:
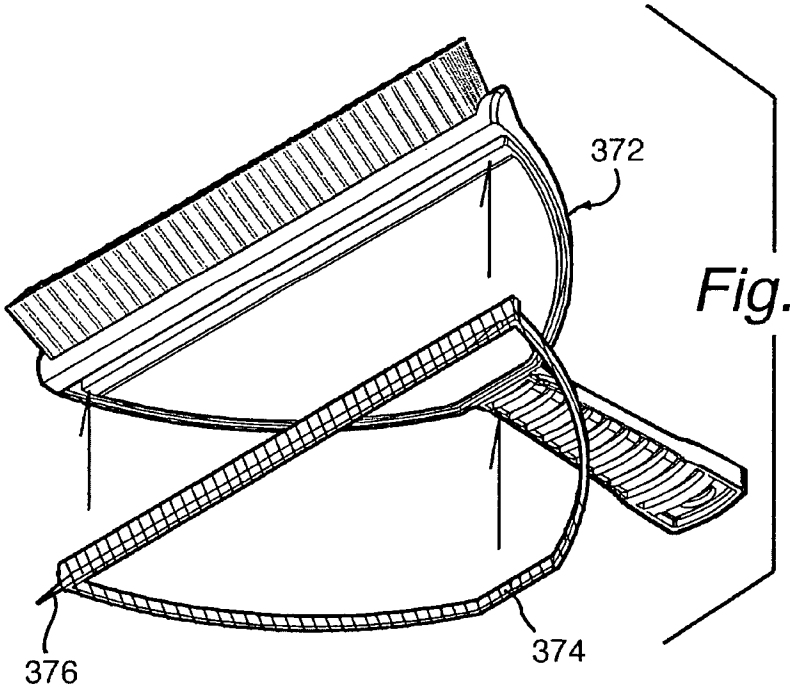
FIG. 79 is an exploded bottom perspective view showing a clearing tool suitable for use in the systems of the invention and incorporating an integrally formed gasket and squeegee blade.
Figure 85:
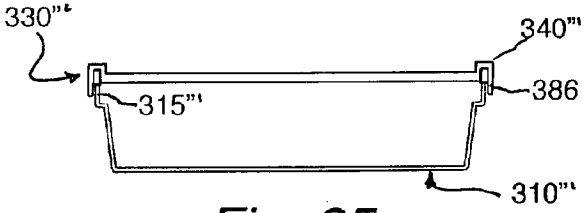
FIG. 85 is a view taken in partial section along line 85-85 in FIG. 84.
Figure 86:
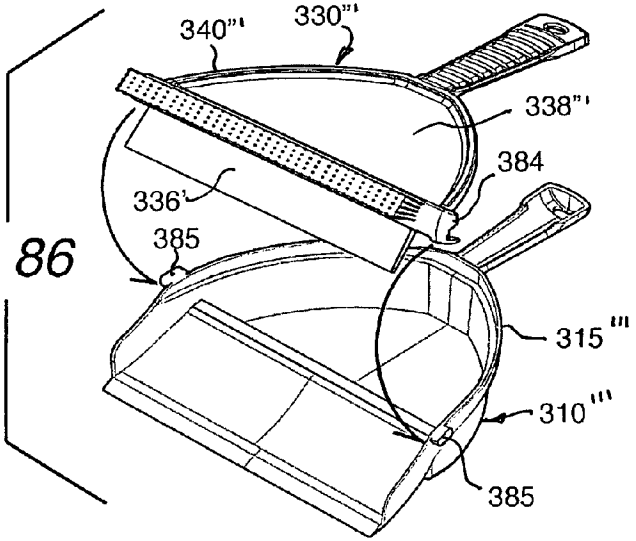
FIG. 86 is an exploded top perspective view of the system of FIGS. 82 through 85.
Figure 84:
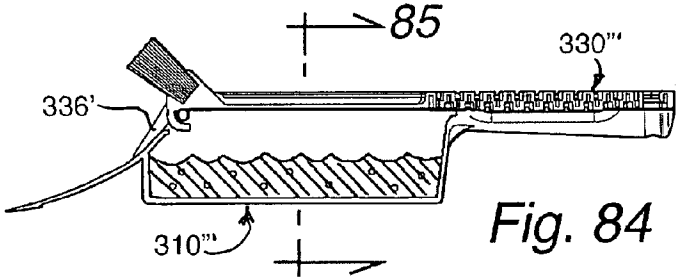
FIG. 84 is a view of the system of FIG. 82, taken in partial section along line 84-84 in FIG. 82.
Figure 83:
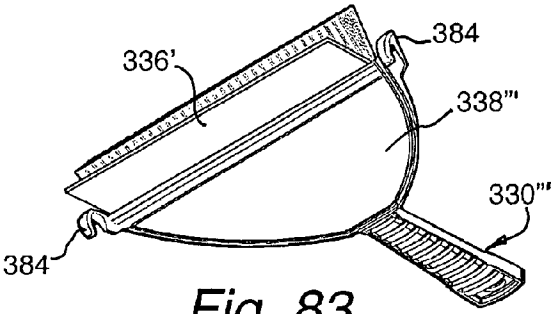
FIG. 83 is a bottom perspective view of the clearing tool and used in the system of FIG. 82.
Figure 82:
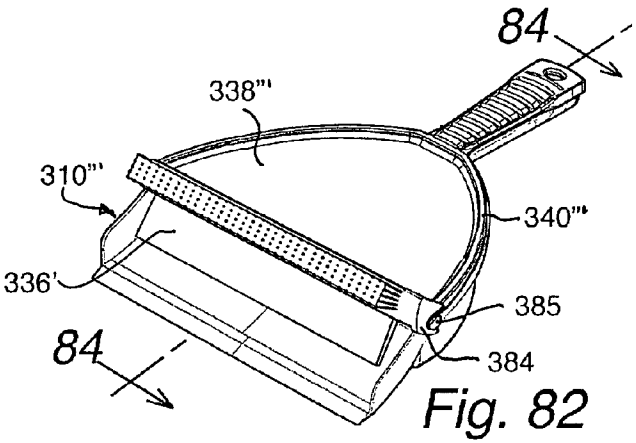
FIG. 82 is a top perspective view of a further form of cleanup systems embodying the invention.

FIGS. 79 through 81 show a clearing tool, generally designated by the numeral 372, constructed with an incorporated gasket 374, which is formed with an integral squeegee element 376. It will be appreciated that such a gasket, or a gasket of any other suitable form, will desirably be incorporated into any of the clearing tools or containment units hereinabove described. In FIG. 80, the clearing tool 372 is assembled in closed relationship with a containment unit, generally designated by the numeral 378, which again may have the features of any of the comparable units described above. As can be seen from the section view, FIG. 81, the gasket 374 is interposed between the mating surfaces of the tool 372 and the wall and shoulder 380, 382 of the containment unit 378. Once again, it should be understood that a similar gasket will desirably be incorporated into any of the systems embodying the invention described with reference to FIGS. 61 through 78 and 82 through 86 (below), with any adaptations that may be necessary or desirable, as will be evident to those skilled in the art.

The system of FIGS. 82 through 86 embodies the invention and is essentially the same as those illustrated in foregoing figures (especially with reference to FIGS. 61 through 64) with the exception that a plain squeegee member 336' is employed, lug elements 385 are provided as pivot elements on the containment unit 310'" in place of the V-shaped recesses 317, and hook like elements 384 are provided on the clearing tool 330'" in place of the insert or lug elements 342. As will be appreciated, and depicted in FIG. 86, in assembling the clearing tool 330'" with the containment unit 310'" the tool is moved downwardly and rearwardly from an overlying position to cause the hook-like elements 384 to receive and engage the lug elements 385, whereupon the tool 330'" is pivoted, with leverage, to its closed relationship with the containment unit 310'", depicted in FIGS. 82, 84, and 85, in which it is maintained by snap-fitting elements of the nature hereinabove described. In this relationship the peripheral marginal portion 340'" on the plate portion 338' overlaps the edge of the marginal portion 315'" of the containment unit 310' to form a seal, the effectiveness of which is enhanced by the presence of the lip 386 on the marginal portion 340'".

It should also be appreciated that the systems of the invention can employ cooperating pivot elements that differ significantly from those of the embodiments described. Rather than providing insert elements on the tool and recess elements on the containment unit, the positions of those elements may be interchanged. Indeed, in some instances it may be desirable to have one insert element and one recess-defining element (of corresponding form) on each of the tool component and the containment unit. It should also be emphasized that the means for maintaining the components in their assembled, closed relationship may vary widely from the form illustrated and described, and may be placed anywhere on, or in association with the system components, as long as the desired relationship is maintained.

Turning now to FIGS. 1-4, the cleanup system consists of a containment unit, generally designated by the numeral 10, and a squeegee tool generally designated by the numeral 30. The containment unit comprises a containment body 12 that defines an interior chamber 14 to which an inclined ramp 16 leads. Low, lateral wall elements 18 extend along the sides of the ramp 16 and curve inwardly to confine and direct matter being moved into the chamber 14. The ramp terminates in a flexible lip element 20 that extends across its forward edge, and a front wall section 21, that is generally vertical in normal use, joins the ramp 16 to the forward part of the bottom wall structure 13 that cooperatively defines the containment body 12.

A handle 22, of generally semicircular cross section, extends rearwardly from the containment section 12; it forms an extension of the semi-circular groove-defining structure 24 that is formed into the top wall 15 of the containment body 12. A short coupling collar 26 projects a from one lateral wall 17 of the containment body 12, and receives a removable (but tethered) cap (shown in its overlying position in these figures); the collar 26 surrounds a clean-out and/or material discharge opening from the chamber 14, and additionally serves for the receipt of a vacuum hose.

The squeegee tool 30 includes an elongated head 32, from the opposite, longer, parallel margins of which extend an elongate blade element 34 of flexible, rubbery material (as is typical of a squeegee tool), and an elongate brush element 36. A flat shoulder plate 40, having a semi-elliptical peripheral edge, extends rearwardly from the head 32, intermediate its long margins, and a handle 38 extends rearwardly from the shoulder plate 40, centrally of and normal to the head 32. A gasket element 42, of conformable rubbery material (e.g., vinyl plastic) extends along the entire peripheral edge of the shoulder plate 40.

Figure 1:
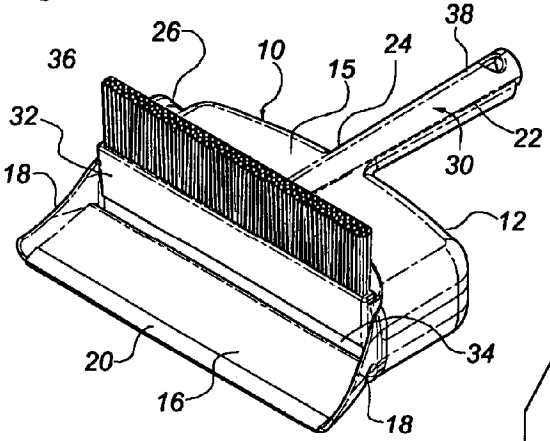
FIG. 1 is a perspective view of a novel cleanup system in which a squeegee tool is assembled with a dustpan-like receptacle or containment unit.
Figure 3A:
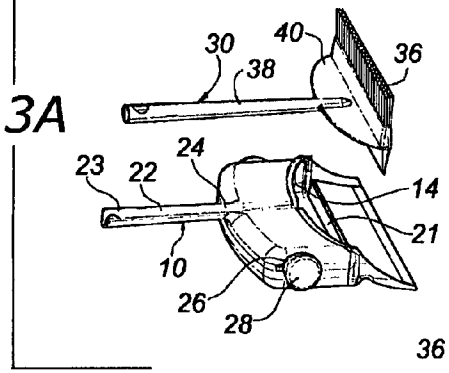
Figure 3B:
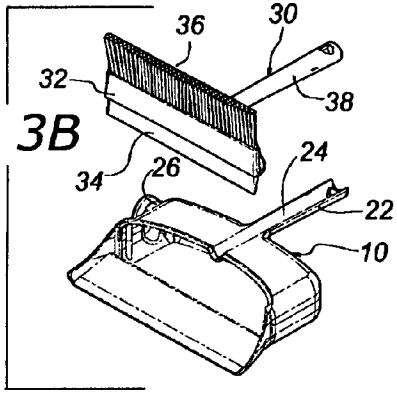
Figure 2A:
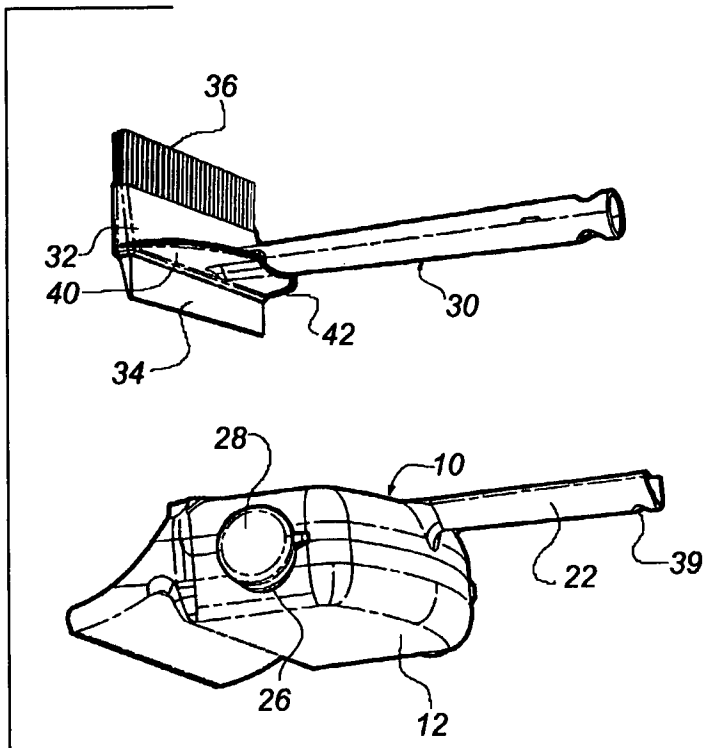
FIGS. 2A and 2B are exploded perspective views of the system of FIG. 1.
Figure 2B:
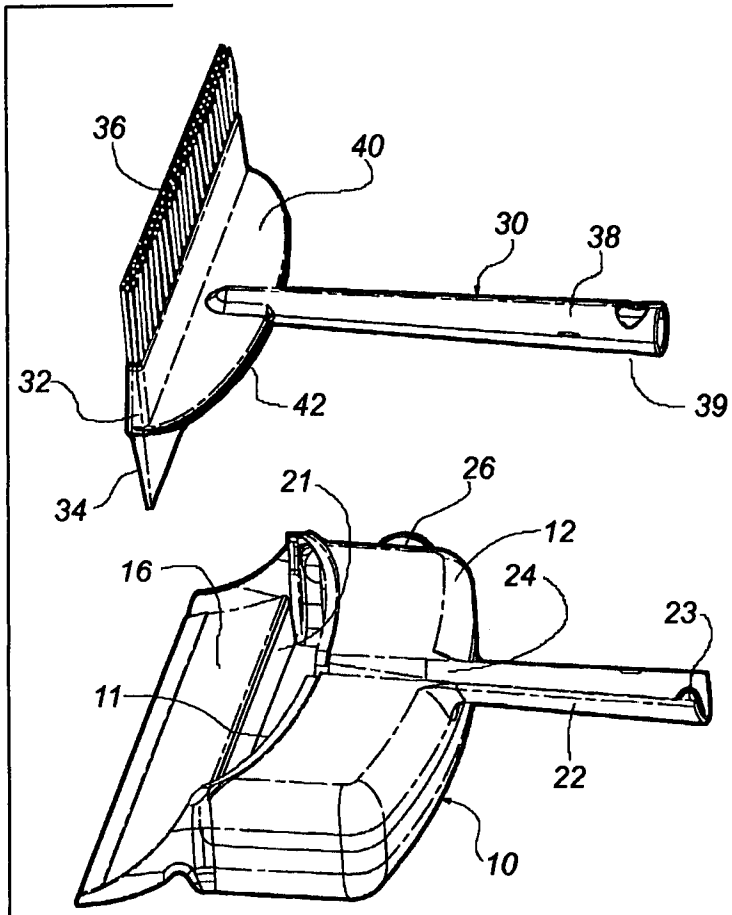
Figure 4:
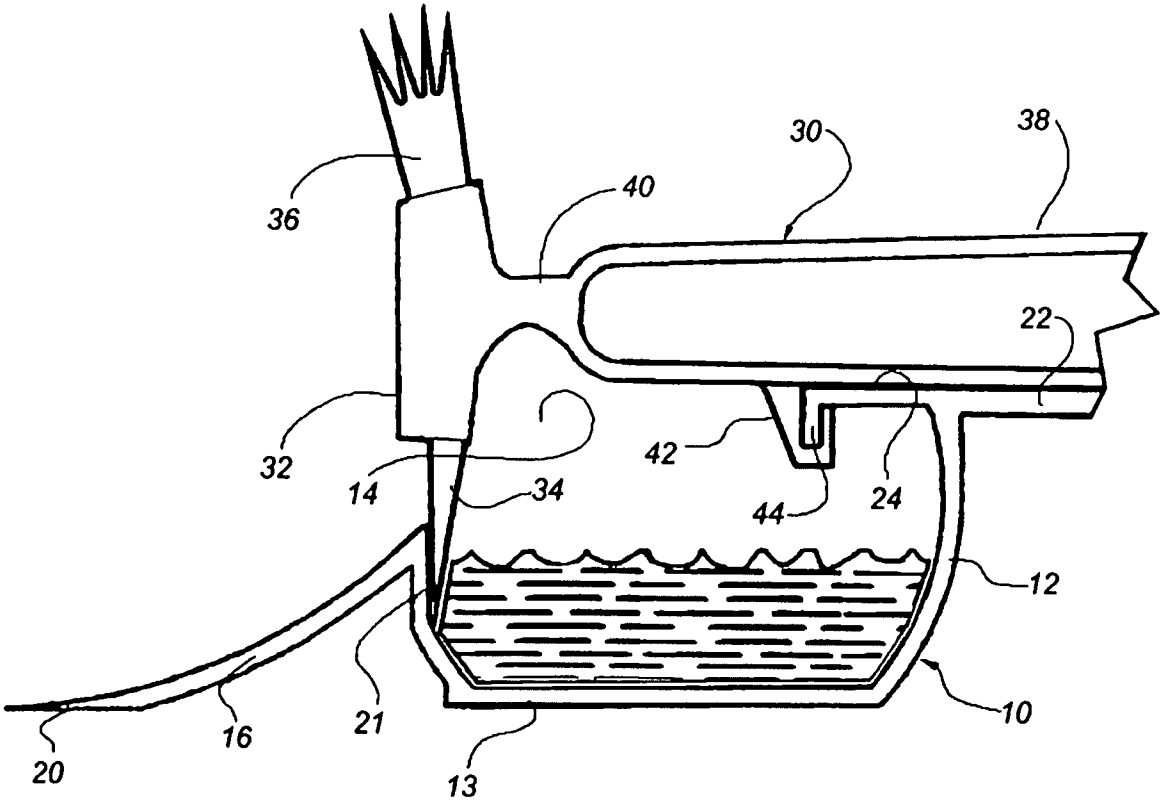
FIG. 4 is a fragmentary sectional view of the system of the foregoing figures, taken along line 4-4 of FIG. 1 and drawn to an enlarged scale.

As can be seen with particular clarity from FIGS. 1 and 4, when the squeegee tool 30 is assembled with the containment unit 10, the tool handle 38 seats in the semicircular handle section 22 and groove structure 24 of the containment body 12. This causes the blade element 34 on the squeegee tool 30 to extend along, and to bear tightly against, the vertical wall section 21 at end of the ramp 16. The gasket element 42 on the peripheral edge of the shoulder plate 40 of the tool 30 simultaneously engages, and bears tightly against, the adjacent, mated marginal portion of the containment body 12 at the entrance to the interior chamber 14; it will be noted that the marginal portion of the body 12 is formed with a narrow depending lip 44, spanning the chamber entrance, to increase the contact area. An upstanding boss 23 on the containment unit handle section 22 seats in a hole 39 in the tool handle 38 to maintain the components in firm interengagement. This feature cooperates with the mating tapers of the handle section 22 and groove 24 of the containment body 12, and the handle 38 of the squeegee tool, to ensure that the blade and gasket elements 34, 42 will be maintained in a tight relationship against the wall section 21 and the lip 44, respectively, thus effectively sealing the chamber 14 and forming a liquid-tight enclosure from which semi-liquid, or fully liquid, matter can not normally escape.

Figure 5:
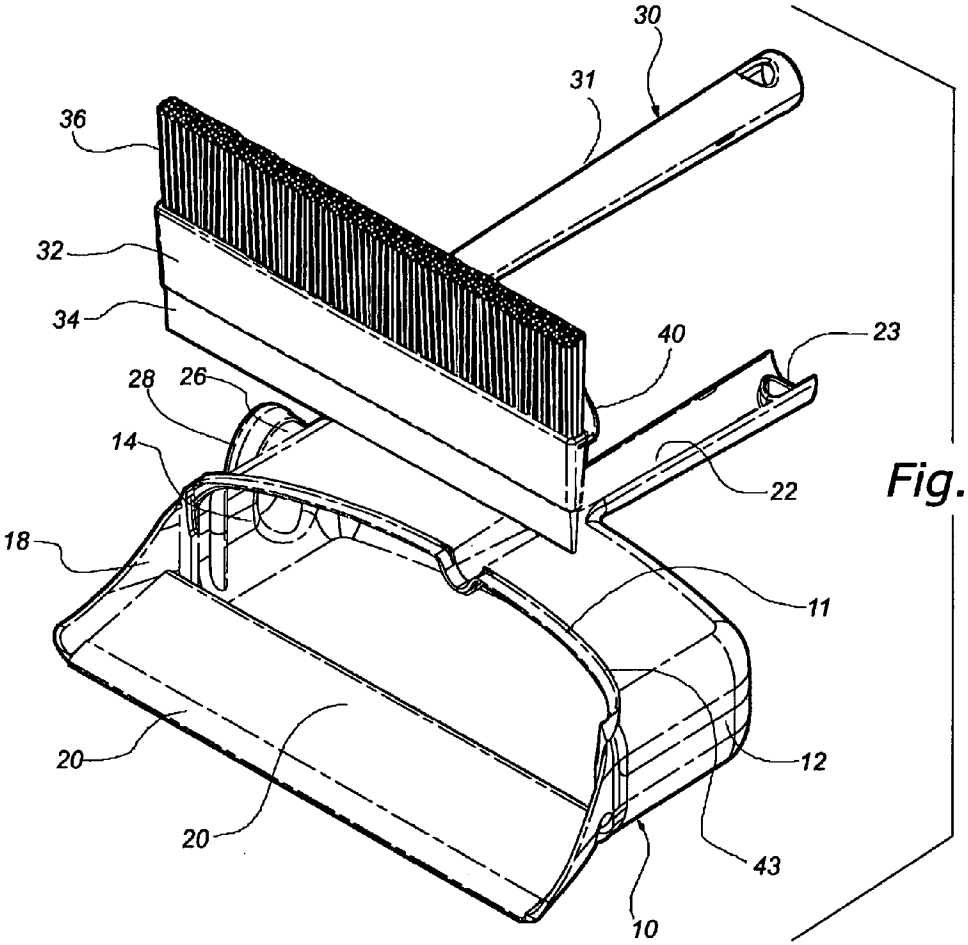
FIG. 5 is an exploded perspective view of a novel cleanup system, slightly modified from the form depicted in FIGS. 1-4.

The system depicted in FIG. 5 is substantially the same as that of FIGS. 1-4, with the exception that, rather than providing the sealing gasket element 42 on the shoulder plate 40 of the squeegee tool 30, a gasket element 43 is affixed to the mating edge of the contain-ment unit, generally designated by the numeral 11, so as to surround, on three sides, the entrance to the chamber 14 thereof. The shoulder 40 of the squeegee tool, generally designated by the numeral 31, is correspondingly devoid of any gasket element on its peripheral edge. The same sealing effect will of course be achieved when the squeegee tool, generally designated by the numeral 31, is assembled with the containment unit 11, in the manner depicted in FIGS. 1 and 4.

Figure 6:
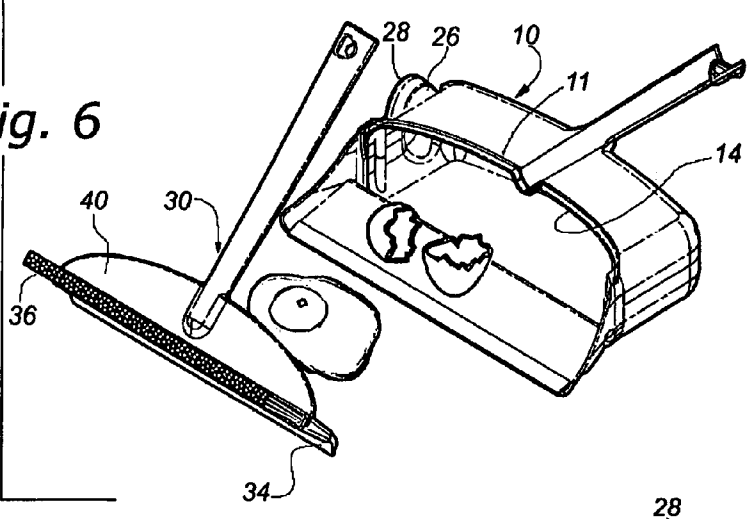
FIGS. 6 and 7 are perspective views showing the system of FIGS. 1-4, further modified and in use for the removal of semi-liquid matter and solid matter, respectively, from a surface.
Figure 7:
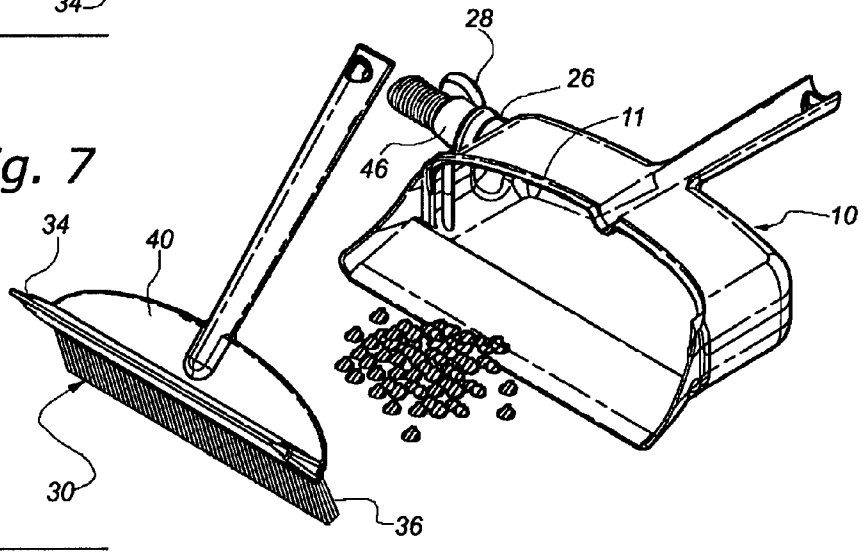

FIG. 6 depicts a system comprised of the containment unit 10 and the squeegee tool 31 (i.e., no gasket element is provided on either component), utilized with the blade element 34 operative for effecting the removal of a semi-liquid material. FIG. 7 shows the same tool 31, rotated to position the brush element 36 for sweeping solid matter into the chamber 14 of the containment body 12. FIG. 7 additionally shows the cap 28 displaced from the coupling collar 26 (surrounding an opening in one of the lateral walls 17 of the containment body 12) to accept the attached vacuum hose 46, thereby causing material swept into the chamber 14 to be drawn into an associated vacuum machine (not illustrated, but taking any suitable form, such as of a conventional dry vacuum cleaner or a wet vacuum system).

Figure 8:
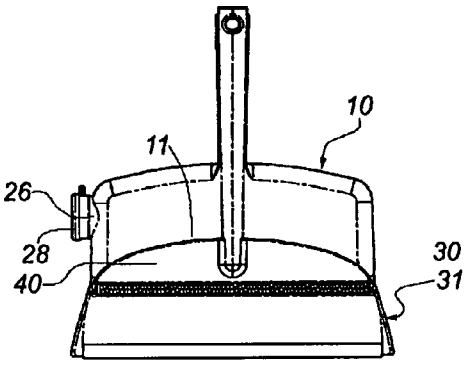
FIG. 8 is a plan view of the system of FIGS. 6 and 7, drawn to a reduced scale and in a storage position.

FIG. 8 shows the squeegee tool 31 in assembly with the containment unit 10. It will be appreciated that, because of the close conformity of the mating surfaces, the internal chamber of 14 of the body 12 is closed (albeit perhaps not optimally sealed, due to the absence of gaskets and leveraged closing action).

Figures 9, 10, 11, 12A, 12B, 12C:
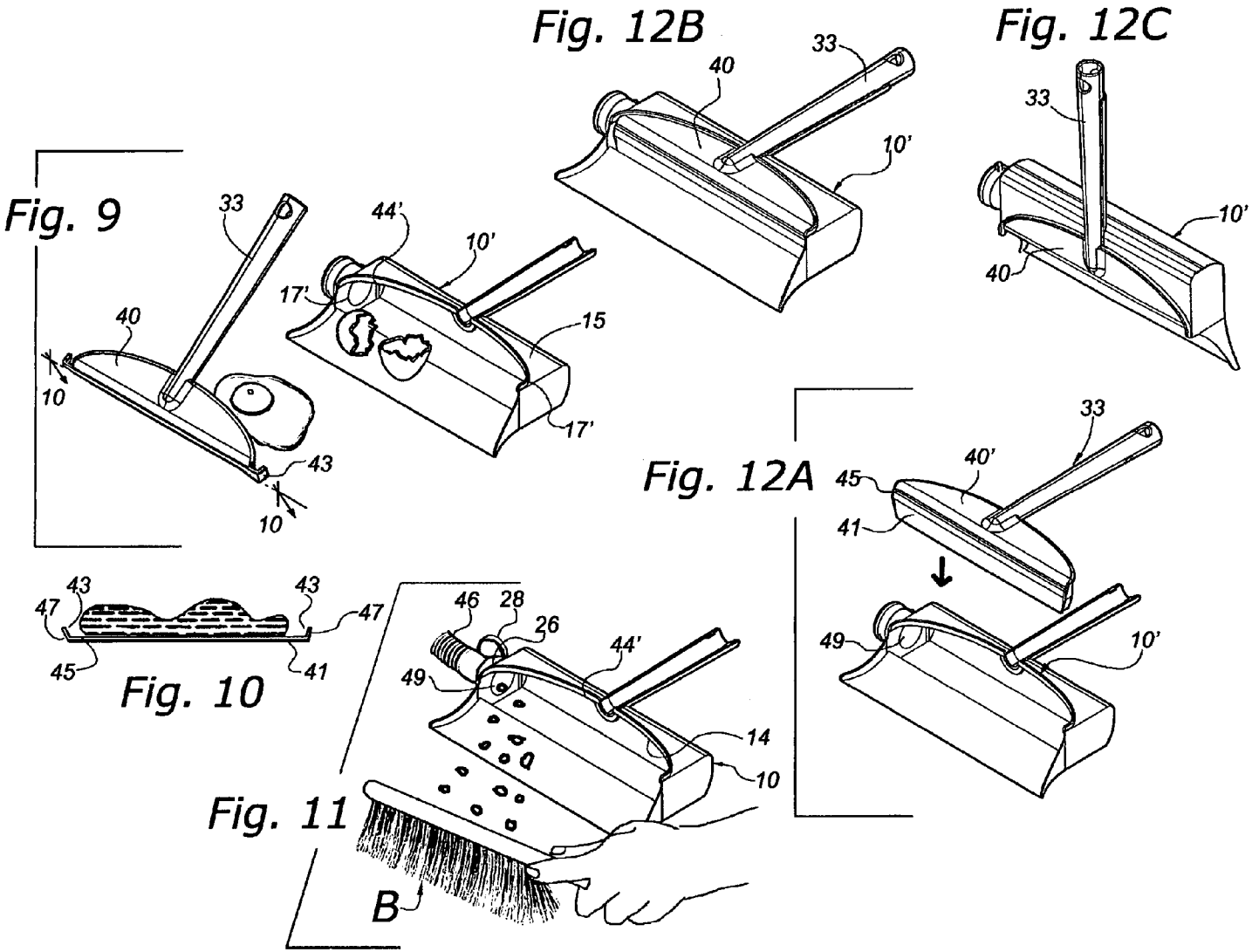
FIG. 9 is an exploded perspective view of a novel cleanup system, in use for the removal of semi-liquid matter from a surface, comprised of a squeegee tool and containment unit.
FIG. 10 is a sectional view taken along line 10-10 in FIG. 9 and showing the configuration of the blade portion of the squeegee tool.
FIG. 11 is a perspective view showing the containment unit of the system of FIG. 9, in use with a brush for the removal of solid matter.
FIGS. 12A, 12B, and 12C show the system of FIG. 9, drawn to a reduced scale and (A) with the squeegee tool positioned for assembly with the containment unit, (B) in assembly with the unit, and (C) in assembly and stored position.

The system depicted in FIGS. 9 through 12 is similar to those hereinabove described with the reference to FIGS. 1-8, but incorporates a number of modifications. Most notably, and as is best seen in FIG. 10, the head of the squeegee tool, generally designated by the numeral 33, consists of a shoulder plate 40' and a depending forward flange 45 having rearwardly directed tab-like elements 43 on its bottom portion. The blade portion 41 incorporates lateral elements 47, which cooperate with tab-like elements 43 and help to confine the semi-liquid matter (depicted as a broken egg) and to minimize leakage or escape past the opposite ends of the blade portion 41. The tool is devoid of any brush-like feature.

As can also be seen, the containment unit 10' is formed to have an upstanding lip 44' on the top wall 15, which cooperates with the peripheral edge of the shoulder plate 40' of the squeegee tool 33 so as to effect closure of the mouth of the internal chamber 14 when the squeegee tool 33 is assembled with the containment unit 10' (as depicted in FIGS. 12B and 12C; FIG. 12A shows the components in registry prior to assembly). The structure of the containment unit 10' along the lateral walls 17' is also configured so as to best accommodate the modified form of the squeegee tool head and, in particular, the tab-like lateral tabs 43 and elements 47.

FIG. 11 shows the containment unit 10' utilized with a separate brush B for the removal of solid, particulate debris. A vacuum hose 46 is connected to the coupling collar 26, formed on the lateral wall 17' and surrounding the hole 49, which is visible in this figure and in FIG. 9.

The systems of FIGS. 13 through 22 are modified significantly from those of the foregoing figures but nevertheless function to contain matter, cleared from a surface, in a closed and effectively sealed chamber. Rather than utilizing a squeegee tool to close the chamber entrance, as in the embodiments previously described, the present systems comprise closure members that are integrated into the containment units.

More particularly, in the system of FIG. 13 through 16 the containment unit, generally designated by the numeral 50, includes a containment body 52 having a circular forward portion comprised of an upper arcuate wall section 55 and a lower arcuate wall section 57 (best seen in FIG. 16), which define a slot-like opening 54 spanning the front of the containment body 52. A ramp 16' intersects with the lower arcuate wall section 57 and leads to the internal chamber 59 of the containment body 52. A curved flange 53 extends across the rear of the containment body 52, and defines an upwardly opening trough 61.

Figure 16:
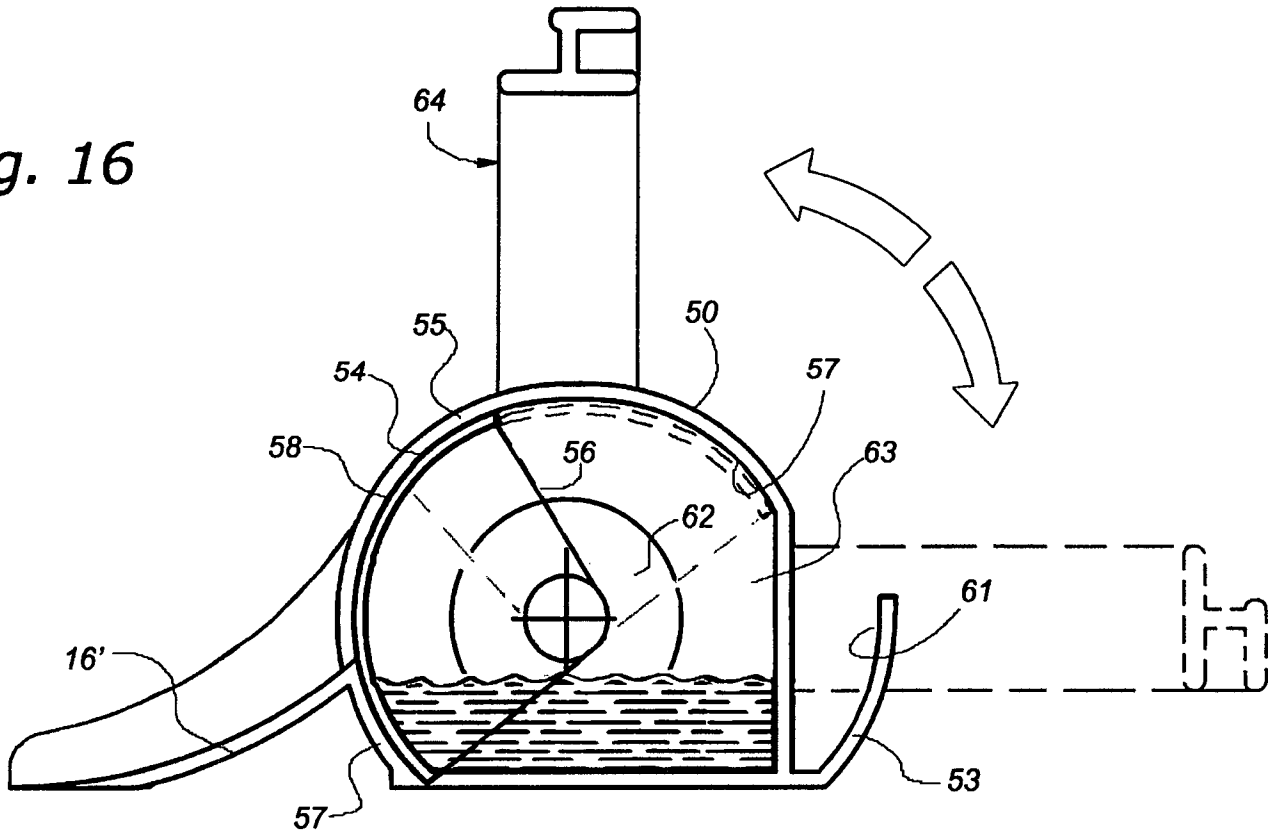
FIG. 16 is a cross sectional view, taken along lines 16-16 of FIG. 14, drawn to an enlarged scale and showing (in full line) the rotating door turned to its closed position.

The containment unit 50 incorporates a revolving door structure, generally designated by the numeral 56, which includes a closure section 58, formed as a cylindrical section, having sectorial flange elements 60 at its opposite ends (only one of which is visible in FIG. 16). Each flange element 60 is fixedly attached to a hub member 62, which members 62 are in turn rotatably mounted in the lateral wall elements 63 that cooperatively define the containment body 52.

The unit 50 also includes a U-shaped handle, generally designated by the numeral 64, comprised of a cross-piece 65, having structure defining a central notch 66 thereon, and arms 67 at its opposite ends. The outer ends of the arms 67 are attached to the hub members 62, and thus enable rotation of the door structure 56 by pivoting of the handle 64 (as indicated by the opposing arrows in FIG. 16).

Figures 13, 14, 15A, 15B:
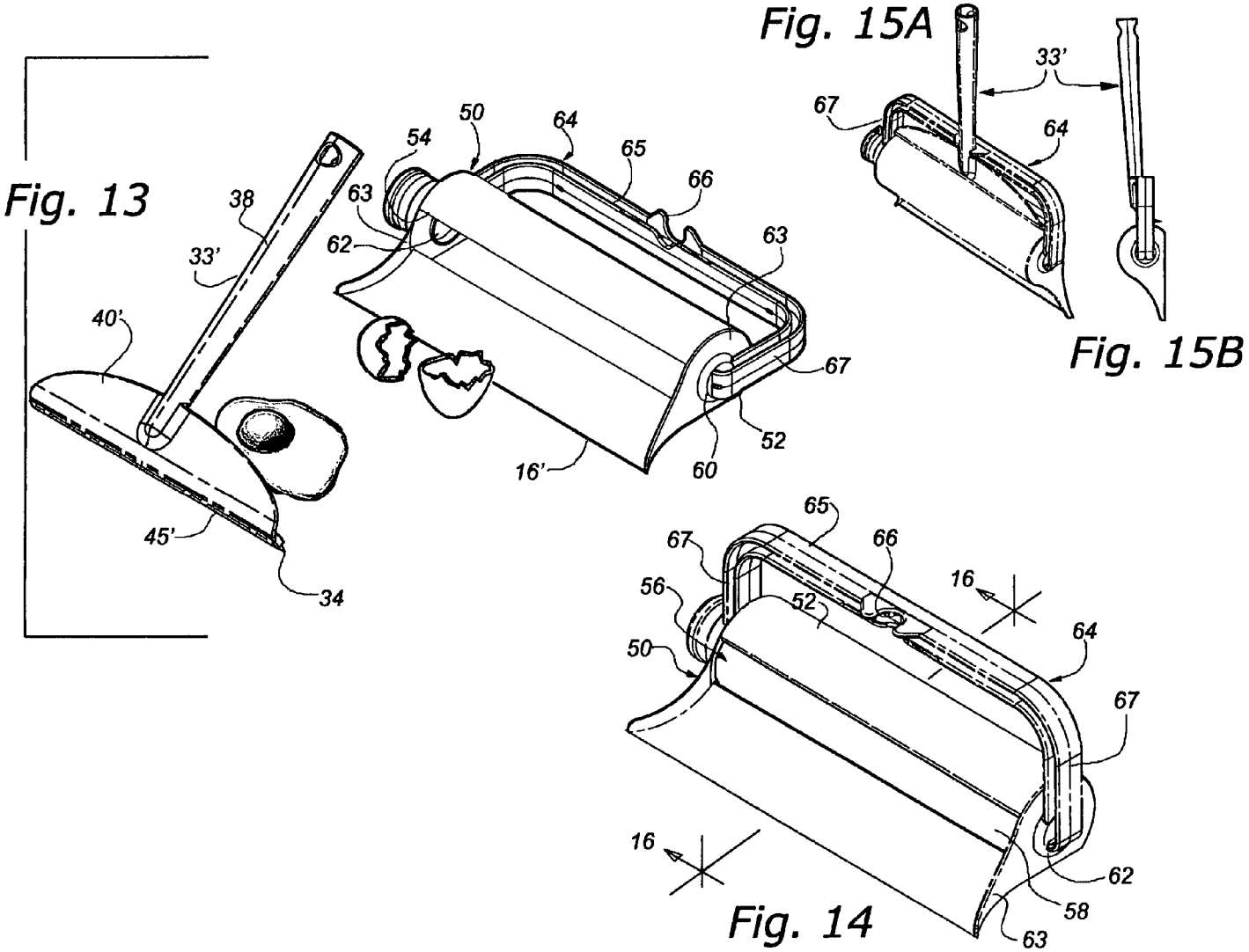
FIG. 13 is a perspective view showing a second form of novel cleanup systems, consisting of a squeegee tool and a containment unit, the containment unit including an integral rotating door that closes, by pivoting of its U-shaped handle, to confine matter within its chamber.
FIG. 14 is a perspective view of the containment unit of FIG. 13 with the handle oriented vertically and disposing the door in its closed position.
FIGS. 15A and 15B are perspective and elevational views, respectively, of the system of FIGS. 13 and 14 in a stored position.

In FIG. 16, the closed position of the closure section 58 of the door structure 56 is depicted in full line (as is also shown in FIG. 14), and the open position is depicted in broken line (and is also shown in FIG. 13). As will be noted, the handle 64 is in an elevated (normally vertical) position for closing the door structure 56 and is in a rearwardly lowered positioned (normally horizontal) for moving the closure section 56 to its open position.

As seen in FIGS. 13, 15A and 15B, a squeegee tool, generally designated by the numeral 33' consists of a tapered handle 38 attached to the shoulder plate 40' of a head structure, which includes a blade element 34 attached to extend across the lower end of a forward flange portion 45'. Needless to say, the squeegee tool 33' is utilized to remove the semi-liquid matter from a surface, onto and up the ramp 16' and into the chamber 59 of the containment body 52. The handle 64 can thereupon be elevated to enable transport of the contents, for disposal, without concern for escape or leakage from the chamber 59. In the stored position, depicted in FIGS. 15A and 15B, a portion of the handle 38 of the squeegee tool 33' adjacent the shoulder plate 40' is received and engaged in the central notch 66 of the containment unit handle 64, with the blade 34 and lower portion of the forward flange 45' seated in the trough 61 defined by the curved flange 53.

Figure 20:
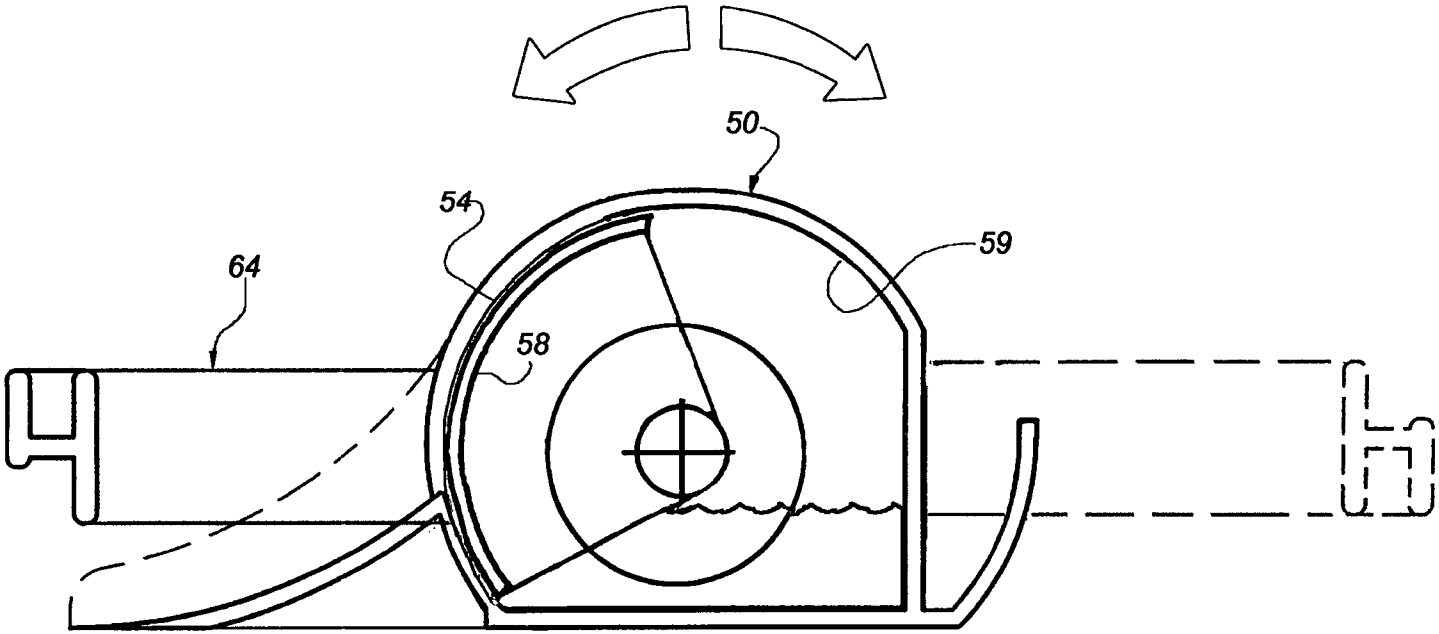
FIG. 20 is a view similar to FIG. 16, taken along line 20-20 of FIG. 19.
Figure 22B:
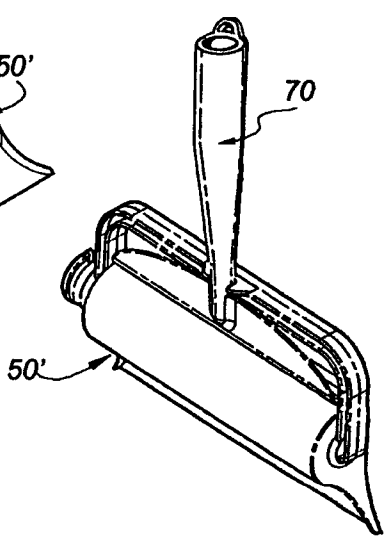
FIGS. 22A and 22B are perspective views of the system of FIG. 21, drawn to a reduced scale and showing the squeegee tool and containment unit in assembly.
Figure 22A:
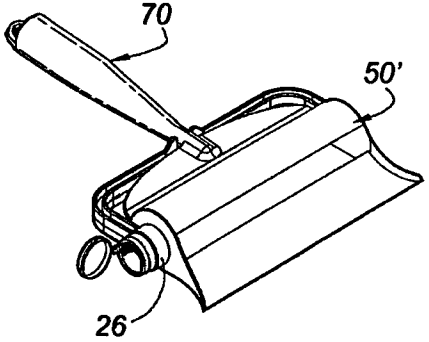
Figure 21:
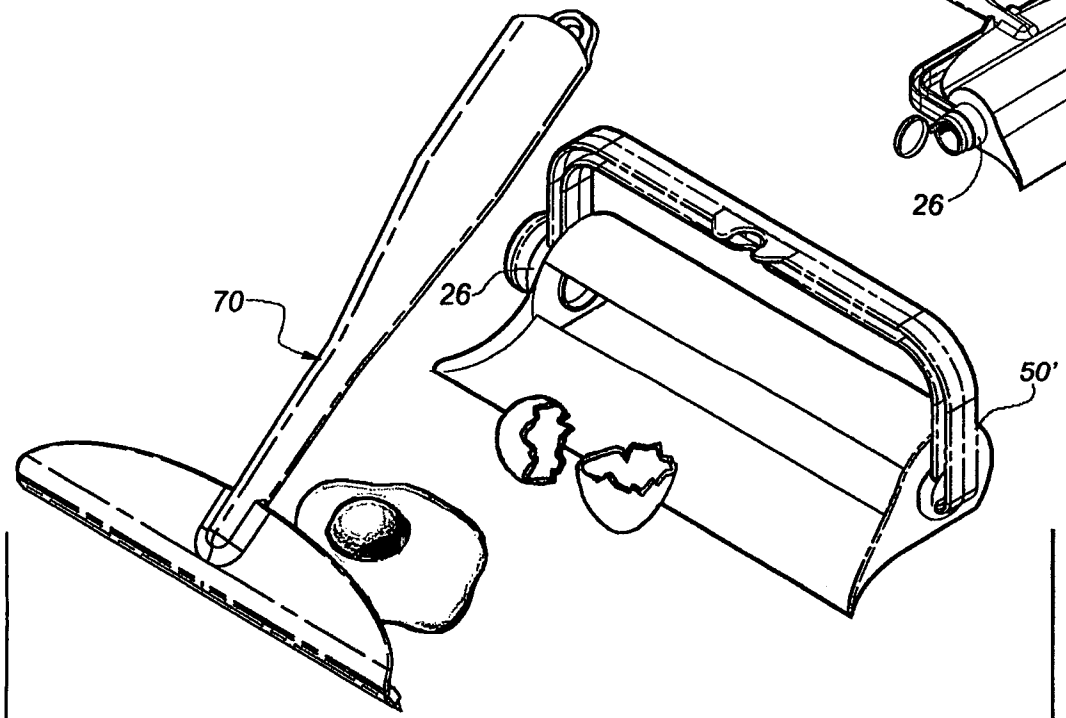
FIG. 21 is an exploded perspective view of a novel cleanup system in which the squeegee tool handle provides an air-flow passage and is adapted to receive a vacuum hose.
Figure 23:
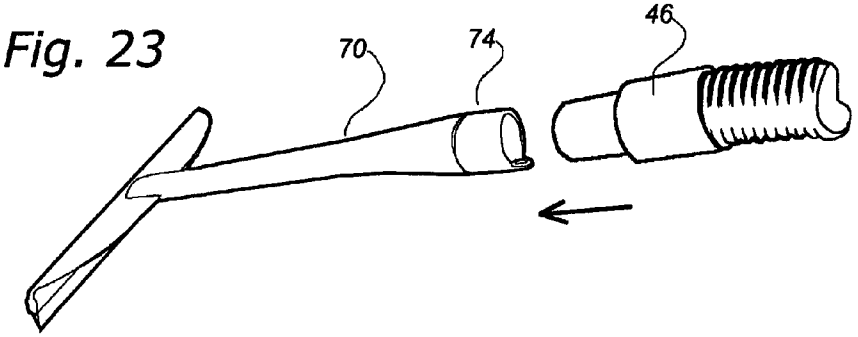
FIG. 23 is a perspective view showing the squeegee tool of the system of FIG. 21, aligned for the receipt of a vacuum system hose.

The system shown in FIGS. 17-20 is substantially the same as that of FIGS. 13-16, with the exception of the effects of the operating handle position. As seen in FIGS. 19 and 20, the handle 64 is rotated to its forward most (normally horizontal) position to cause the closure section 58 to block the opening 54; as seen in FIGS. 16 and 18 (and indicated in FIG. 20), the closure section 58 is displaced away from the opening 54 when the handle 64 is either vertical or in its rearwardly directed horizontal position.

FIG. 18 shows use of the containment unit 50 for effecting the removal of debris using a brush B. Ultimate removal is assisted by evacuation of the chamber 59; the vacuum machine hose 46 is attached to the unit 50 as hereinabove described.

Figure 24:
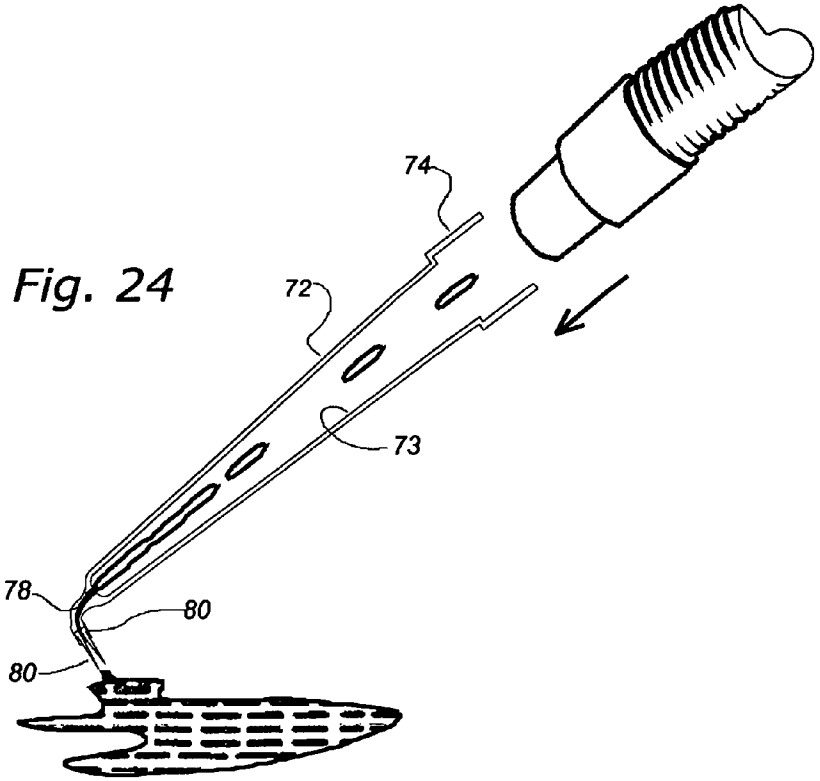
FIG. 24 is a view similar to FIG. 23 but showing the squeegee tool in cross section.

The system depicted in FIGS. 21-24 is also similar to the systems of FIGS. 13-20, with the exception that the squeegee tool, generally designated by the numeral 70, is adapted for use not only with the containment unit 50' but also by direct connection to any suitable vacuum system through its hose 46. Thus, as is best seen in FIG. 24, the handle of the squeegee tool 70 consists of a hollow tapered section 72 having a bore 73, a cylindri-cal collar section 74 at one end, and a suction head 76 at the opposite end. The head 76 is formed to define at least one fluid flow passage 78 in communication with the bore 73, and a pair of squeegee-like blade elements 80 are provided along an intake slot. When attached to a vacuum, the material to be removed is drawn into the passage 78 of the head 76, and through the bore 73 of the handle 72 and the vacuum hose 46. As will be appreciated, both the squeegee 70 and also the containment unit 50' can be used with or without an applied vacuum. A storage position for the cleanup system is depicted in FIGS. 24A and 24B.

Figure 28:
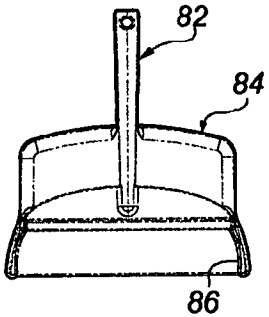
FIGS. 27 and 28 are perspective and plan views, respectively, of the system of FIGS. 25 and 26, wherein the squeegee tool and containment unit are interengaged in a mated closed relative position.
Figure 26:
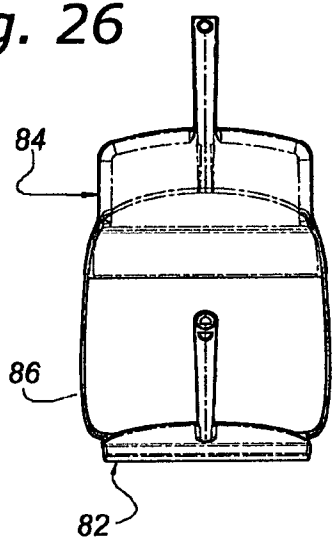
FIG. 26 is a plan view of the same system, as depicted in FIG. 25 and drawn to a reduced scale.
Figure 27:
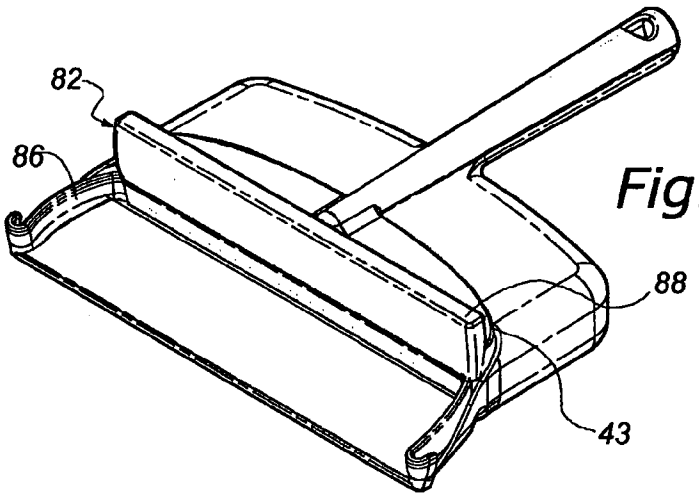
Figure 25:
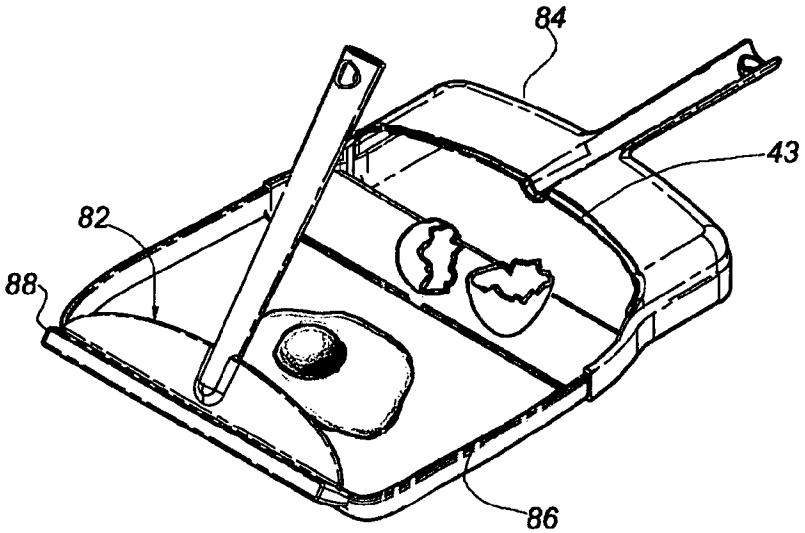
FIG. 25 is a perspective view showing a further novel cleanup system, wherein a flexible belt or band integrates the squeegee tool and the containment unit, the components being displaced from one another.

FIGS. 25 through 28 illustrate another novel cleanup system, wherein a driving tool, generally designated by the numeral 82, is tethered to a containment unit, generally designated by the numeral 84, by a flexible band 86, which may take the form of a stretchable V-belt, typically about 18 to 24 inches long. The head 88 of the tool 82 is slotted to engage the upper edge of the flexible band 86, such that the engaged length of the band functions as a squeegee element. Moving the driving tool 82 towards the containment unit 84 (or vice versa), with the band 86 completing an enclosure of the matter to be removed (as depicted in FIGS. 25 and 26), effectively advances the matter up the ramp and into the chamber of the containment unit. Such movement also causes the band 86 to fold inwardly, in a closed relationship with the tool snapped neatly and in mated engagement with the containment unit (as depicted in FIGS. 27 and 28), effectively sealing the chamber entrance and enabling secure transport of the contained material to a desired location for disposal. A spring motor or like mechanism (not illustrated) can be used to draw the ends of the band 86 into the housing of the containment unit 84. As can be seen, a gasket element 43 partially surrounds the mouth of the containment unit chamber, and cooperates for the prevention of material leakage or escape.

The containment unit of the system depicted in FIGS. 29-33, generally designated by the numeral 50", is of generally similar construction to that which is illustrated in FIGS. 13-16. In this embodiment however the squeegee tool, generally designated by the numeral 90, consists of a generally rectangular frame-like handle 92 having a head portion 94 that extends along one of the longer sides of the rectangular and in which a blade element 96 is secured; grip-enhancing structure 97 is provided on the other of the longer sides of the rectangle.

Figures 29, 30, 31, 32, 33:
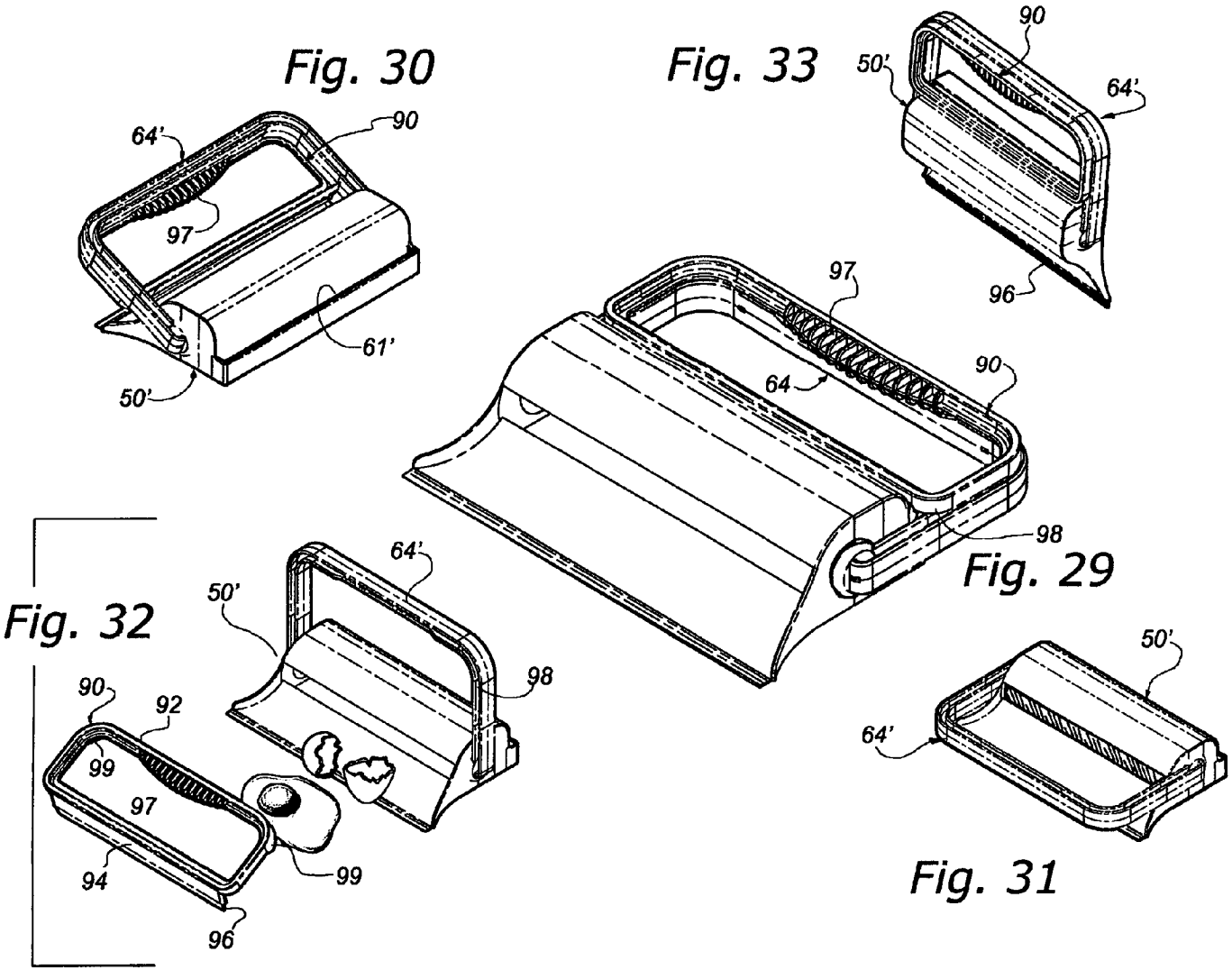
FIG. 29 is a perspective view of another novel cleanup system, in which the squeegee tool is dimensioned and configured to conform to and engage with the U-shaped handle of the containment unit.
FIG. 30 is a rear perspective view of the system of FIG. 29, drawn to a reduced scale and showing the handle and the contained squeegee tool inclined forwardly from an upright orientation.
FIG. 31 is a front perspective view of the system of FIGS. 29 and 30, showing the handle and assembled squeegee tool oriented in a fully forward (normally horizontal) position in which the door of the containment unit closes the internal chamber.
FIG. 32 is a perspective view of the system of FIGS. 29-31, showing the squeegee tool removed from the handle and in use for clearing away semi-liquid matter.
FIG. 33 is a perspective view, drawn to a reduce scale, showing the system of FIGS. 29-32 in a storage position.
Figure 36:
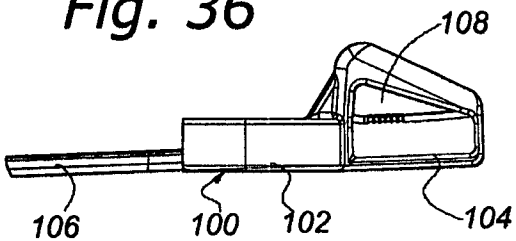
FIGS. 35 and 36 are bottom and side-elevational views of the system of FIG. 34, drawn to a reduced scale.
Figure 35:
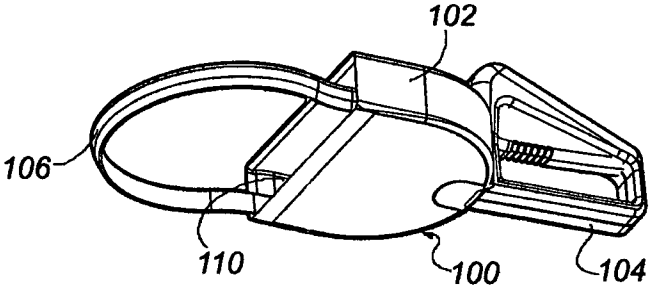

The tool 90 is dimensioned and configured to conform to the outer portion of the U-shaped handle 64' on the containment unit 50", with sufficient clearance to permit free pivotal movement of the handle. A slot 98 is molded into the handle 64', and serve to frictionally engage ears 99 that project from the handle 92 of the squeegee tool 90, thus enabling ready assembly with the containment unit handle 64'. A trough 61' is formed along the back of the containment unit 50" and receives the head portion 94 and blade element 96 of the tool 90 when the handle 64' is positioned in the orientation shown in FIG. 29. FIGS. 30 and 31 show the system with the handle 64' oriented partially and fully forwardly, respectively; FIG. 32 shows the system in use with the handle 64' in an upright, normally vertical orientation; FIG. 33 shows a stored position of the system.

Figure 37:
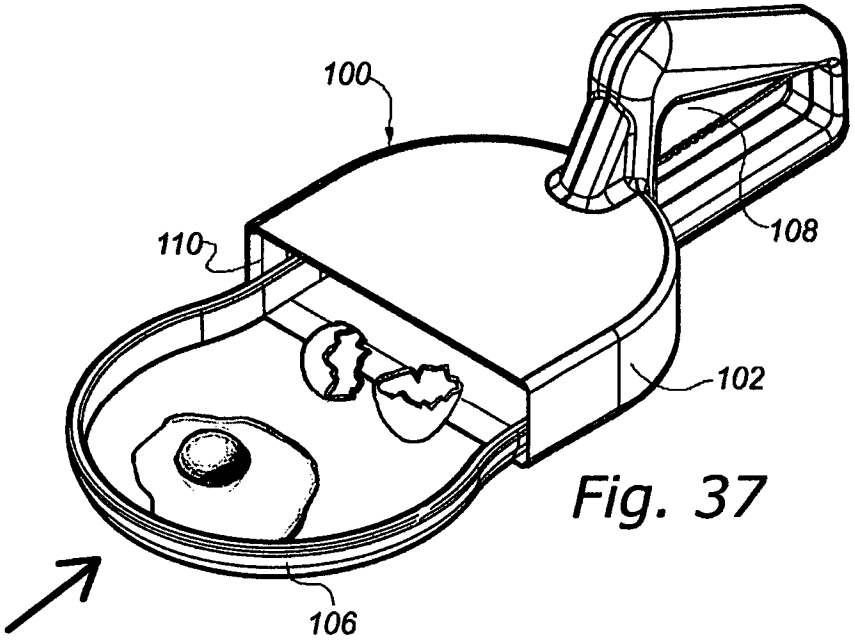
FIG. 37 is a front perspective view of the system of FIGS. 34-36, shown in use to effect removal of semi-liquid matter.
Figure 34:
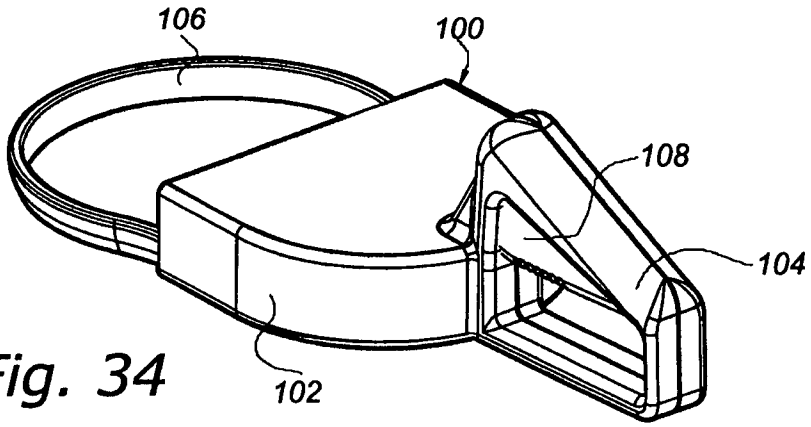
FIG. 34 is a rear perspective view of yet another novel cleanup system, which includes a flexible band, or recoil loop, that can be drawn mechanically into the containment unit to function in the manner of a squeegee tool.

The cleanup system of FIGS. 34-37 consists of a containment unit, generally designated by the numeral 100, comprised of a containment section 102, which is of generally semi-elliptical form, and a handle 104 that projects from one edge of the containment section. A resilient, quick recoil loop or band 106, operatively connected to a trigger 108 disposed within the handle 104, extends from the opposite side of the containment 102; the loop 106 may desirably be of PVC fabrication. As seen in FIG. 37, the system of this embodiment is utilized by surrounding the matter to be removed with the resilient band 106. Upon operation of the trigger 108, at least one of the opposite ends of the band 106 is retracted into the containment section 102 (such as by actuation of a spring motor or the like with a single pull) of the trigger 108, or by a mechanical pumping or ratcheting action effected by multiple trigger pulls, so as to thereby draw the matter into the chamber 110 of the section 102; a blade or lip 12 is provided at the entrance to the chamber so as to facilitate movement of material thereinto.

Figures 38, 39, 40:
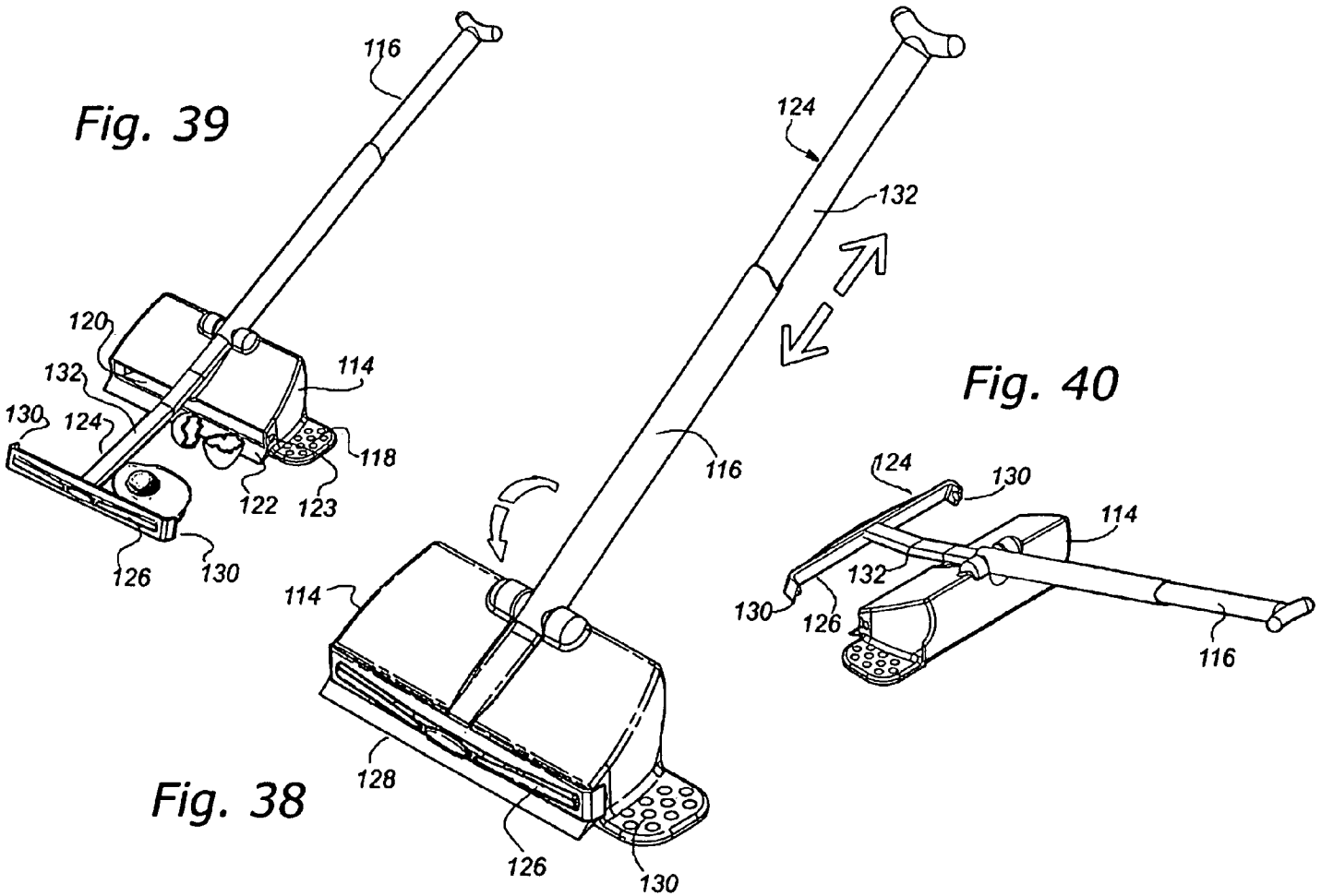
FIGS. 38-40 are perspective views of still another novel cleanup system, wherein the squeegee tool has a stem that is slideably engaged within a tubular handle, pivotably attached to the containment unit, and wherein the head member of the tool closes the entrance to the containment unit.

In the cleanup system illustrated in FIGS. 38 through 40, the containment unit, generally designated by the numeral 114, is of box-like construction and includes a tubular guide sleeve 116 pivotably attached centrally at the top. A hold-down step plate 118 projects laterally from one side, and a blade or lip element 122 extends along the front of the unit 114 for facilitating the entry of matter into the chamber 120; engagement detents 123 (one of which is visible in FIG. 39) are formed into the opposite lateral walls of the containment unit 114, adjacent the chamber mouth.

The squeegee tool component, generally designated by the numeral 124, of which the system is comprised includes an elongate head 126 having an attached blade element 128, with rearwardly directed tab formations 130 at its opposite ends.

The tabs 130 are formed with projecting bosses (not visible), which extend inwardly for cooperative engagement with the detents 123. A tubular stem or handle 132 extends from a central location of the squee-gee tool head 126, and is slidably received within the tubular guide sleeve 116 on the containment unit 114.

As will appreciated, in use of the foregoing system the stem 132 of the squeegee tool 124 is first slid forwardly, within the guide sleeve 116, so as to position the head 126 in a spaced relationship to the containment unit 114 (as depicted in FIGS. 39 and 40). With the matter to be removed located between the head 126 and the unit 114, the stem 132 is pulled rearwardly so as to draw the matter into the chamber 120. In the fully retracted position, depicted in FIG. 38, the blade element 128 of the squeegee tool 124 closes the opening into the chamber 120, again to maintain the matter therewithin against leakage or escape. In the fully closed condition illustrated, the engagement bosses on the tab formations 130 seat in the detents 123 to cooperate in maintaining the head against inadvertent displacement. The pivotable handle 116 allows the user to apply variable pressure against the floor while pulling in a spill, or other deposited matter.

Figure 43:
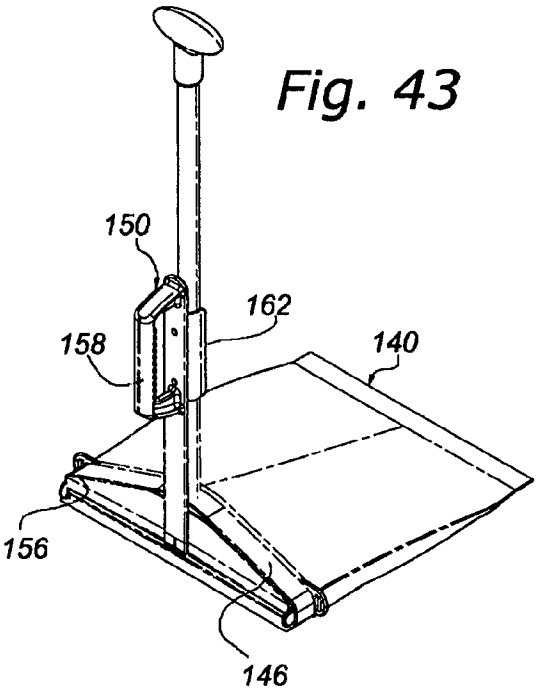
FIGS. 41-43 are perspective views of yet a further novel cleanup system, comprised of pivoting squeegee tool and a bag-like containment unit, interconnected by slidably-received lateral guide and confinement strips.
Figure 41:
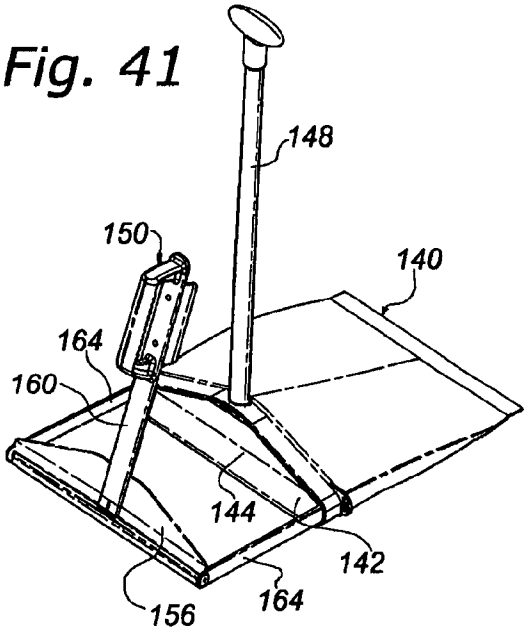
Figure 42:
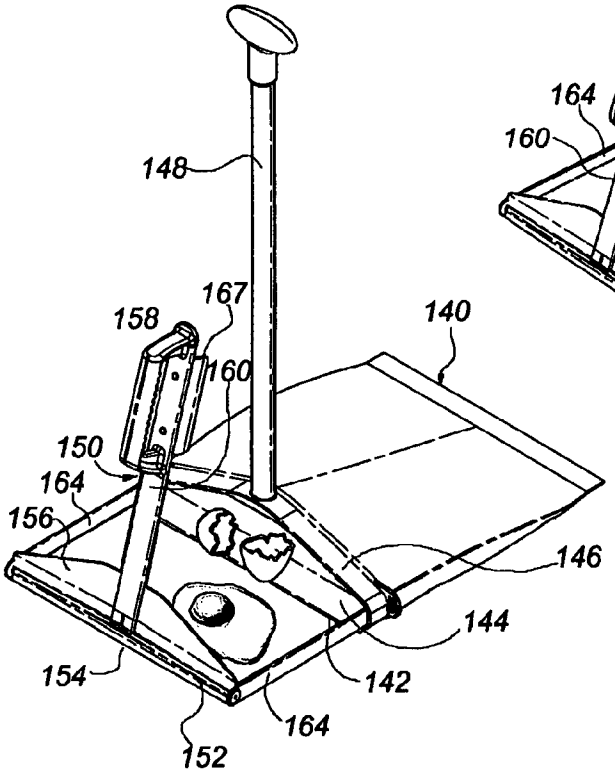

The cleanup system illustrated in FIGS. 41 through 43 consists of a containment unit, generally designated by the numeral 140, in the form of a bag-like structure (e.g., a "poly-bag") having a lip or blade element 142 extending across its forward, lower edge at the mouth of the internal chamber (not visible), which is normally closed by a freely pivoting door or dam 144. A frame 146, having a flattened, generally triangular configuration, surrounds the open end of the bag 140 and is attached thereto for maintaining the open configuration. A normally upstanding handle 148 is disposed centrally on the frame 146.

A squeegee tool, generally designated by the numeral 150, consists of a trans-verse head 152 which supports a blade element 154 that extends along its length. A closure web 156 is attached to the head 152 on the side opposite to the blade element 154, and is shaped to conform (in cooperation with the head 152 and associated elements) to the space defined within the triangular frame 146 of the containment unit 140. A handle 158 is attached, by a connecting bar 160, to the head 152 of the squeegee tool, and its carries a snap-action friction clamp 162 that projects from an inner surface. A pair of rigid guide strips 164, pivotably connected to the squeegee head 152, extend from the opposite ends of the head and are slidably received within the containment unit 140.

As depicted in FIGS. 41 and 42, the system is in condition for use with the head 152 of the squeegee tool 150 spaced away from the bag 140 and with (in particular reference to FIG. 42) the matter to be removed surrounded by the bag 140, the squeegee tool head 152, and the guide strips 164. Sliding the squeegee tool 150 to the closed position illustrated in FIG. 43 (guided by the strips 164) effects displacement of the dam 144 and movement of the matter into containment unit bag 140, and it causes the web 156 and head elements to effectively seal the opening to the chamber 144.

Figure 44:
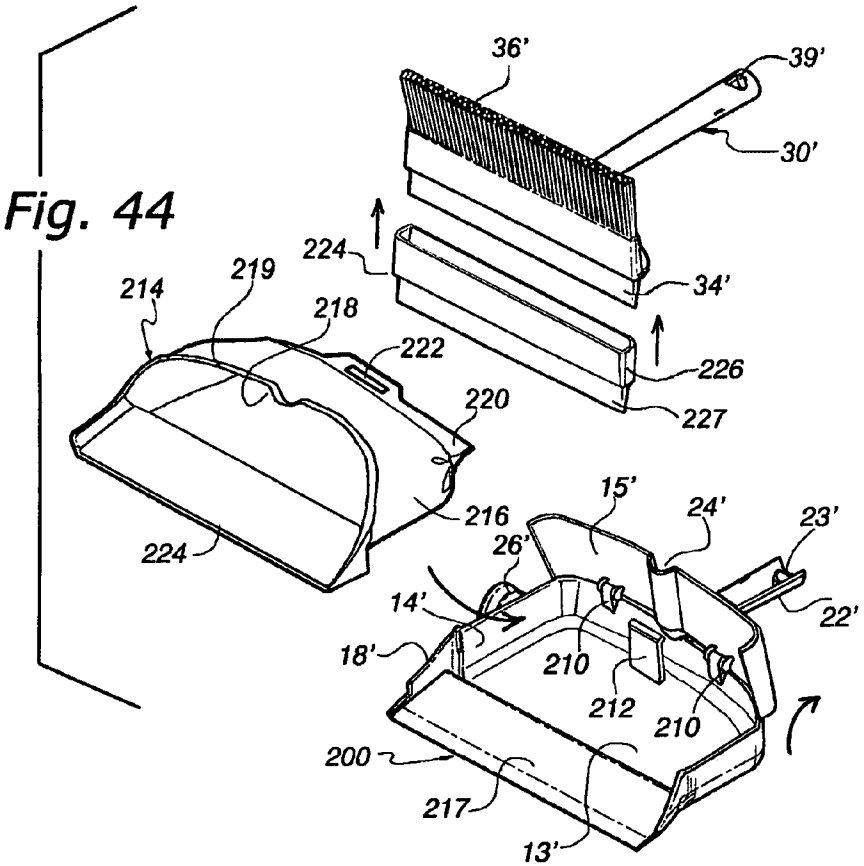
FIG. 44 is an exploded perspective view showing components of a modified form of a system of the kind illustrated in FIGS. 1 through 12, wherein the containment unit includes a replaceable bag-like insert.
Figure 45:
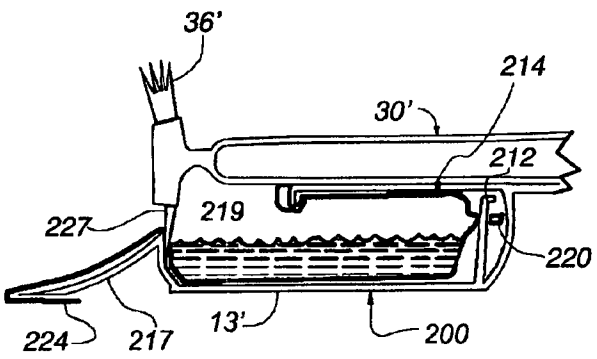
FIG. 45 is a view of the assembled system of FIG. 44, taken in cross section.

Turning now in detail to FIGS. 44 and 45 of the drawings, therein illustrated is a modified form of the system depicted in FIG. 1 through 12, in which the containment unit, generally designated by the numeral 200, is of "clamshell" form and is adapted for use with an assembled, disposable bag-like insert, generally designated by the numeral 214.

The containment unit 200 consists of a rigid body 12' and a lid 15', which is pivotably connected to the body 12' by hinges 210. The lid 15' is normally closed, to mate with the body 12' and to function as a top wall for cooperatively defining the interior chamber 14' of the containment unit 200; the lid 15' can readily be pivoted upwardly to provide easy access to the interior chamber 14'. A flat post element 212, having a retaining lip 213 at its upper end, extends upwardly (in the normal orientation of the containment unit) from the bottom wall structure 13' and serves to retain the insert 214 in assembly within the body 12'.

The insert 214 will normally be fabricated from a polymeric material (e.g., a vinyl polymer, polyethylene, or polypropylene), and consists of a main body portion 216 having a reinforced front mouth opening 218 and a fin seal 220 across the back; the reinforcing element 219 is best seen in FIG. 45, engaged over the edge of the lid 15'. The seal 220 is formed with a centrally located slot or loop 222, which is dimensioned and configured to receive, and engage, the upstanding post 212. Sheath-like structure 224 is formed at the lower front of the body 216, and provides a pocket in which the ramp portion 217, which extends forwardly from the body 12', is received.

FIG. 45 shows the insert 214 hooked in assembly with, and contained within, unit 200.

As is shown in FIG. 44, the clearing tool, generally designated by the numeral 30' is also modified from that of the previous figures, essentially by the incorporation of a disposable squeegee cover or attachment, generally designated by the numeral 224 and consisting of a collar section 226 and a blade element 227. Assembly is effected simply by inserting the existing squeegee blade element 34', and adjacent head structure, of the tool 30', through the collar 226 of the cover 224. Needless to say, use of the cover 224 renders the system entirely reusable, despite having been employed for obnoxious or toxic matter.

Figures 46, 47:
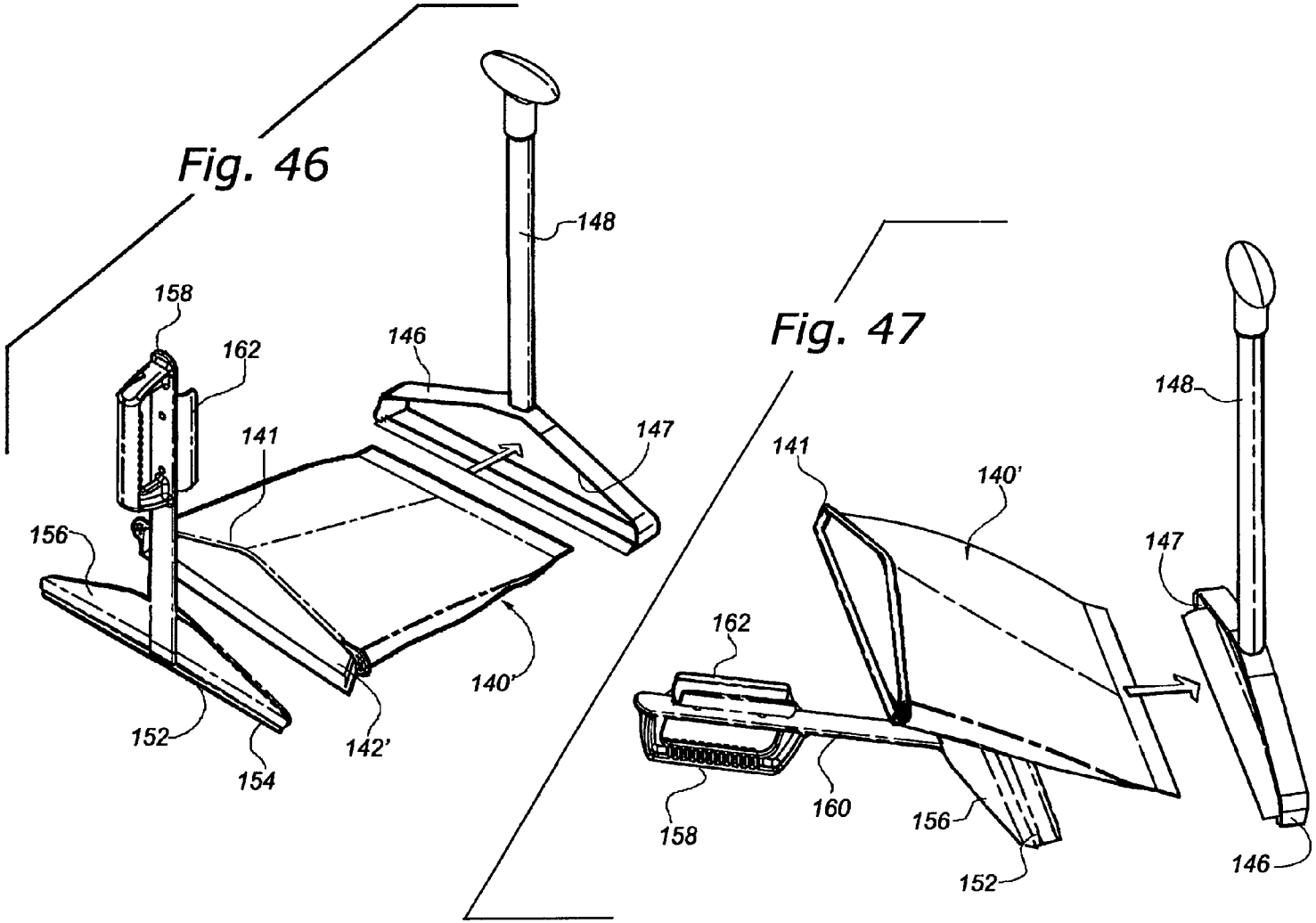
FIG. 46 is an exploded perspective view showing components of a modified form of a system of the kind illustrated in FIGS. 41 through 43, wherein the bag-like containment unit is removable from the supporting frame.
FIG. 47 is an exploded perspective view similar to that of FIG. 46, taken from a different perspective and with the components in a somewhat different orientation and relationship to one another.
Figure 48:
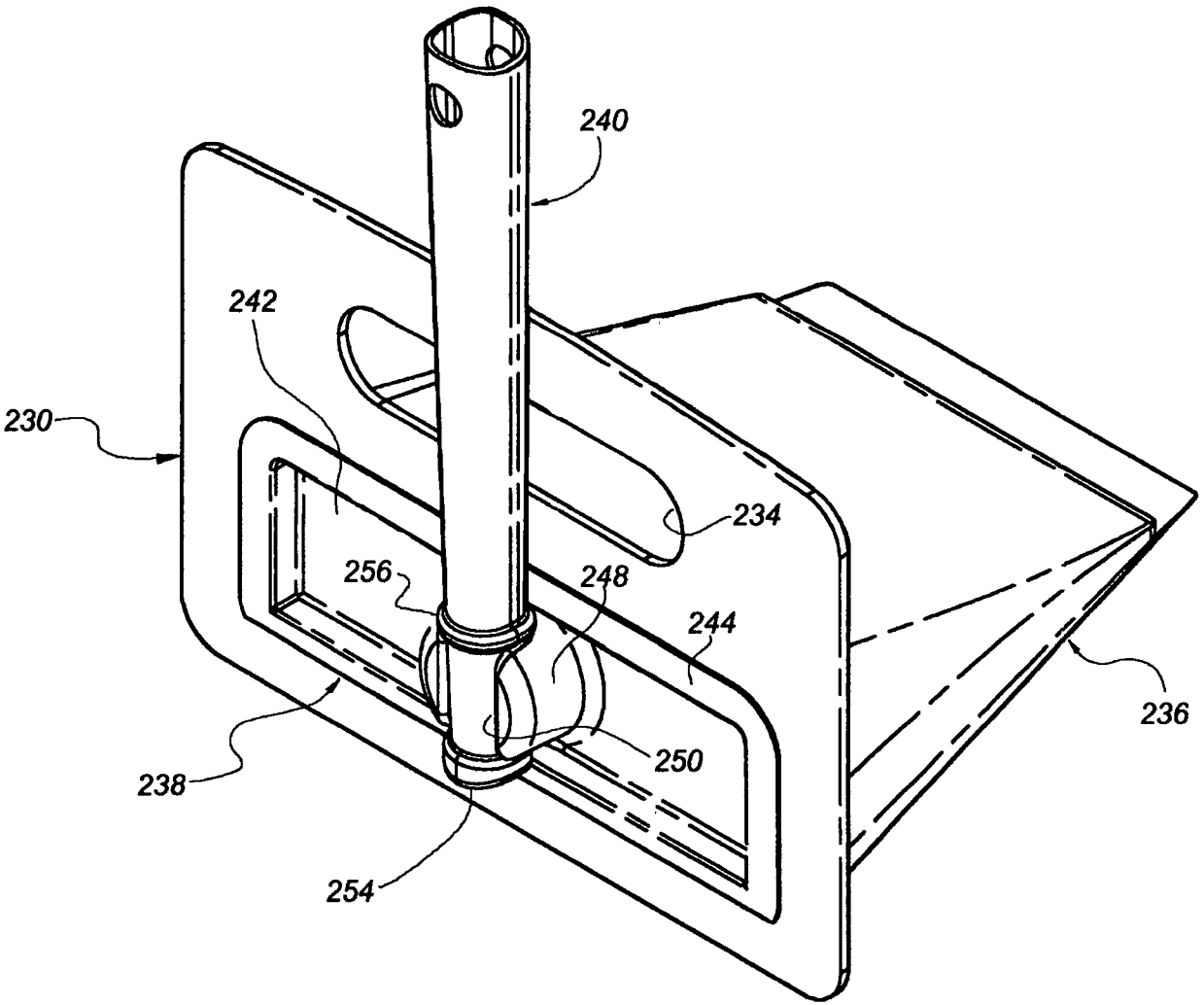
FIG. 48 is a perspective view of yet another novel cleanup system, wherein a bag-like container is affixed to generally planar front structure, with which is associated a squeegee tool comprised of a head member and a removable handle.

The system depicted in FIGS. 46 and 47 is similar that shown in FIGS. 41 through 43, with the exception that the bag-like structure 140' is disengageably assembled within the opening 147 of the frame 146. The structure 140' is formed with reinforcement 141 surrounding its mouth, and its leading edge may be provided by a rigid lip or blade element 142', functioning as a ramp and having integral pull tabs. Here again, the system provides economic and convenience benefits by permitting ready removal of the bag-like structure 140', for disposal.

Turning now to FIGS. 48 through 59 of the drawings, the systems therein illustrated consist of front structure, generally designated by the numeral 230 and taking the form of a planar panel; the front structure will normally fabricated from chipboard, paperboard, or other inexpensive rigid or semi-rigid material, but a wide variety of different forms may be substituted, and any suitable material may be employed for fabrication. A relatively large rectangular aperture 232 is formed through a lower portion of the panel 230, and a smaller aperture 234 is formed upwardly adjacent to it. A bag-like receptacle, generally designated by the numeral 236 and having a mouth 237 at one end, is attached (by fusion or adhesive bonding, or by other suitable means) in the marginal area surrounding the mouth 237 to the back side of the panel 230, with the mouth disposed to completely surround the rectangular aperture 232.

Figure 52:
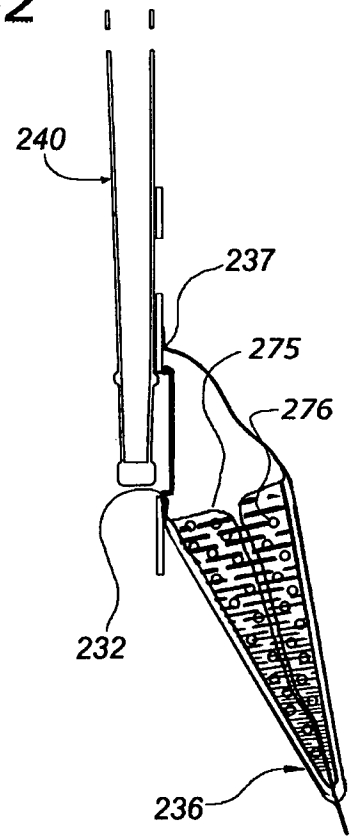
FIG. 52 is a view similar to that of FIG. 51, but wherein the bag-like receptacle itself contains a bag or other insert filled with an absorbent material.
Figure 51:
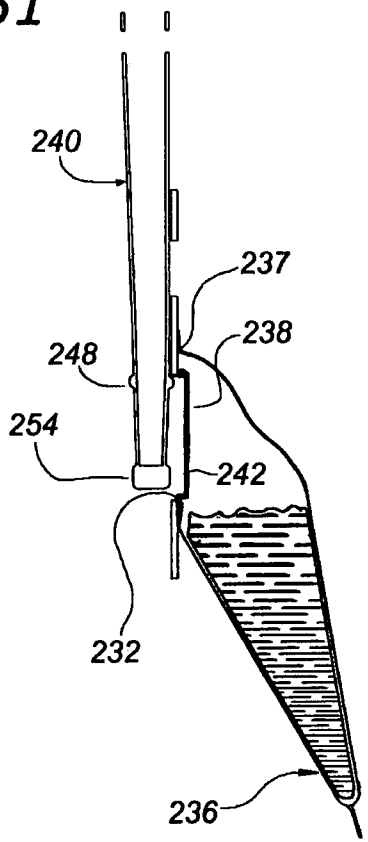
FIG. 51 is a sectional view showing the system of FIGS. 48 through 50 in which the container is filled with matter and elevated from any supporting surface.

FIG. 52 shows a modification in which the receptacle 236 contains an insert 275, desirably in the form of a double-wall bag, filled with a highly absorbent material or medium 276. The walls of the insert 275 are porous or perforated, for the ready admission of liquid matter to be taken up by the absorbent material 276, and ultimately disposed of with the receptacle 236. As depicted, the insert and absorbent material are filled with liquid matter, and thus are enlarged and swollen from a relative flat state in which they may be provided. The construction of the insert 275 may be similar to that of commonly available disposable diaper products.

The clearing tool depicted consists of a head member and a tubular handle, generally designated by the numerals 238 and 240, respectively. The head member 238 will advantageously be fabricated as a thin, vacuum-formed plastic piece, configured to have a main panel portion 242, a surrounding flange 244, and a central, upstanding boss 248 having slot 250 extending transversely (diametrically) from top to the bottom thereacross; an integral squeegee element 246 extends from the flange 244 along the bottom edge of the head member 238.

Figure 55:
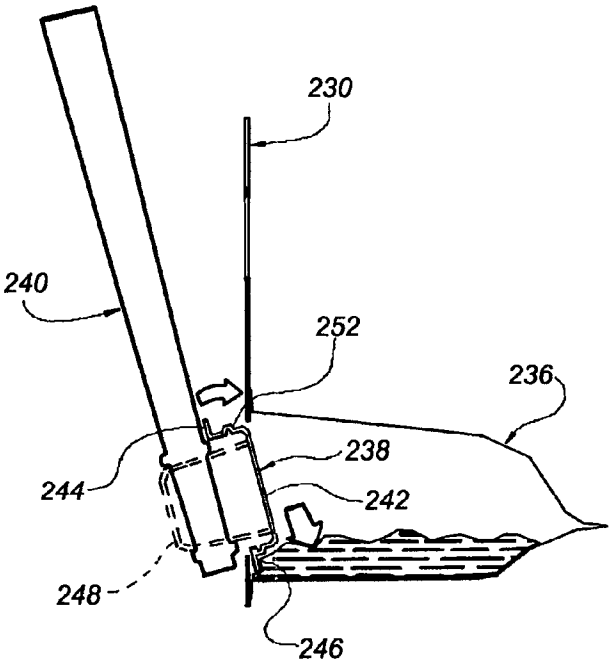
FIG. 55 is a cross sectional view depicting the same stage of assembly.
Figure 54:
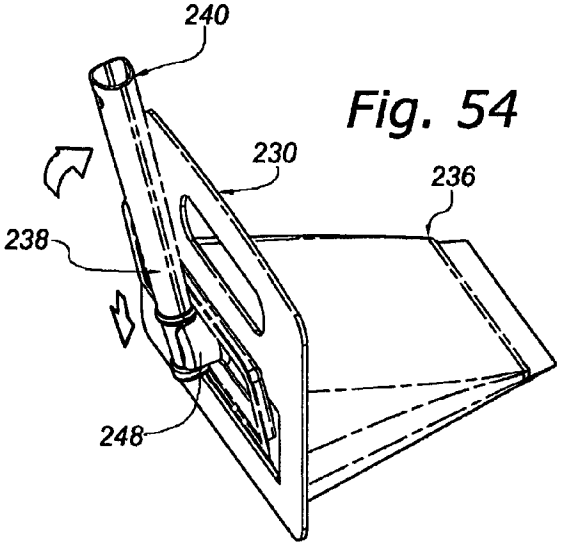
FIG. 54 is a perspective view showing the clearing tool, of the preceding figures, being assembled with the containment unit.
Figure 56:
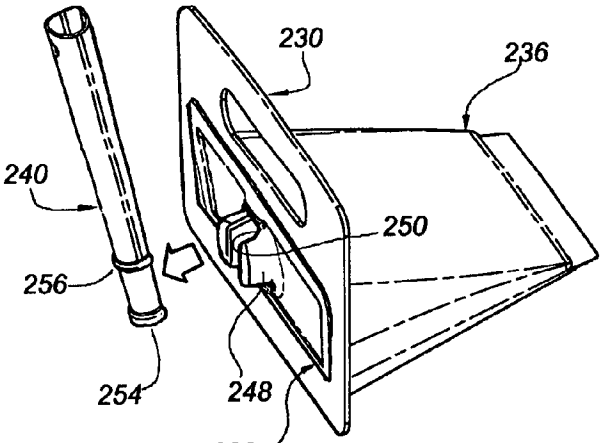
FIG. 56 is a view similar to FIG. 54, wherein the head member of the clearing tool is attached to the containment unit and the handle has been removed.
Figure 58:
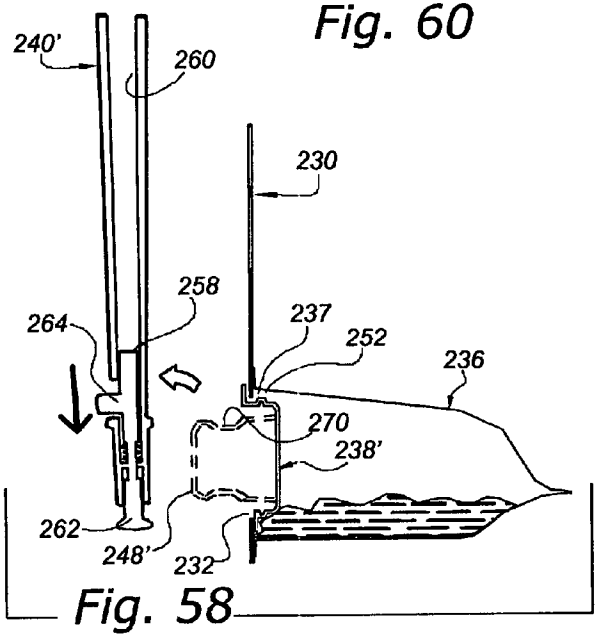
FIG. 58 is a view similar to that of FIGS. 55 and 57, with the handle removed and with the locking mechanism depressed for enabling removal.
Figure 57:
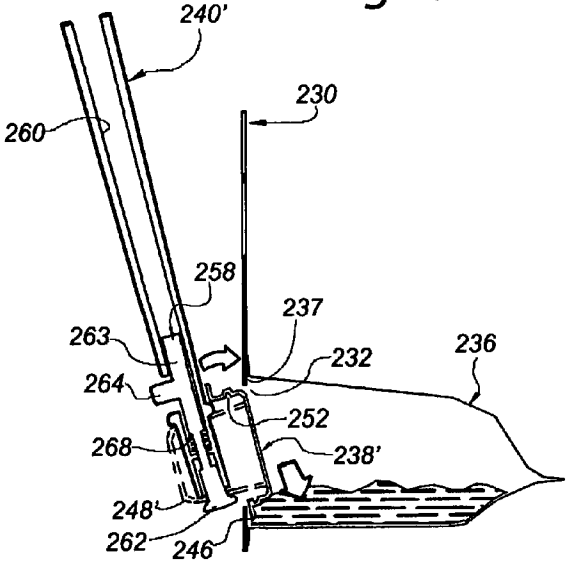
FIG. 57 is a view similar to that of FIG. 55, but wherein the handle incorporates a locking, or engaging, mechanism.

As is best seen in FIGS. 55, 57, and 58, the head member is formed with an upstanding (continuous or discontinuous) ridge 252 behind the flange 244, which extends along at least its top edge, and preferably along its lateral edges as well. In assembly (the act of which is depicted in FIGS. 54 and 55), the corresponding marginal portions of the front panel structure 230 surrounding the aperture 232 engage, in a snap-fit relationship, between the ridge 252 and the corresponding portions of the flange 244, with the integral squeegee element 246 engaged behind the lower margin of the aperture 232. The head member 238 is thereby held securely, but disengageably, in assembly with the panel 230.

As can also be seen in these figures, the tubular handle 240 of the clearing tool, which may desirably be of injection-molded plastic construction, is removable from the head 238 member, thereby enabling its repeated use. The end section of the handle 240, between the terminal knob 254 and the spaced collar 256, is constructed for snap-fit interengagement within the slot 250 of the head member boss 248, to permit ready assembly and disassembly.

Figure 50:
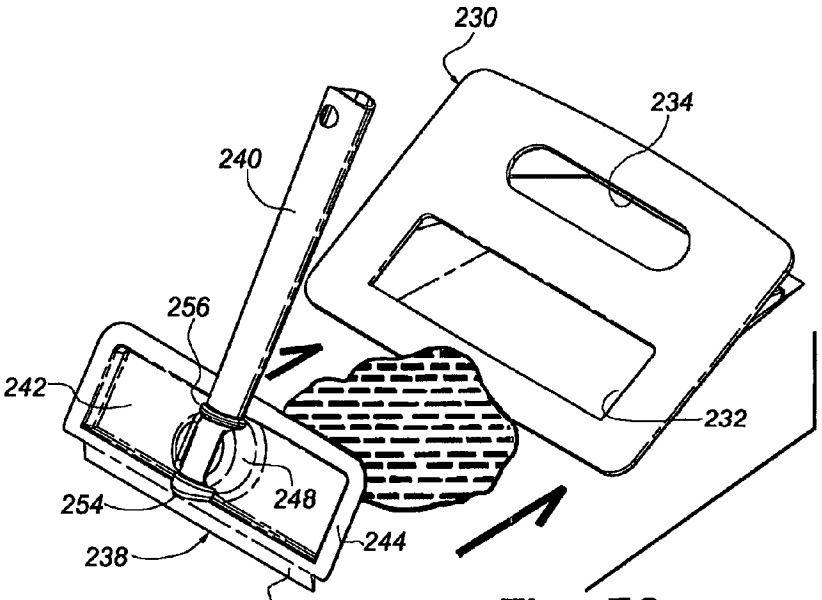
FIGS. 49 and 50 are perspective views of the system of FIG. 48, drawn to reduced scales, showing the squeegee tool removed from the containment unit and, in FIG. 50, showing it in use for clearing away semi-liquid matter.
Figure 49:
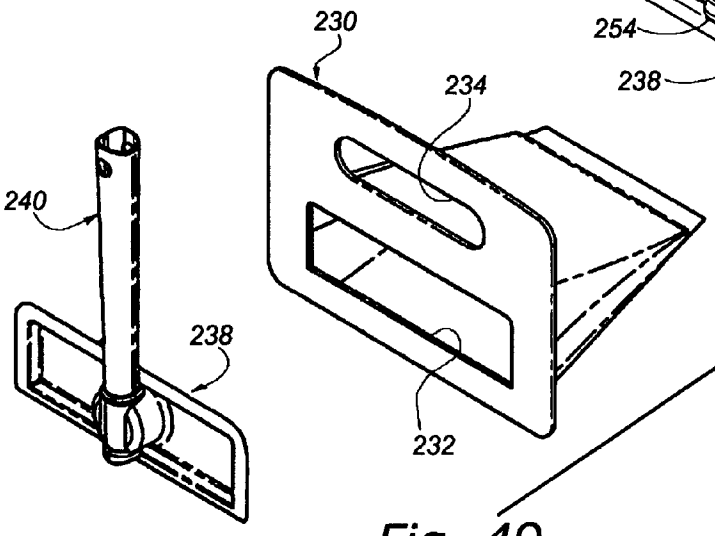
Figure 53:
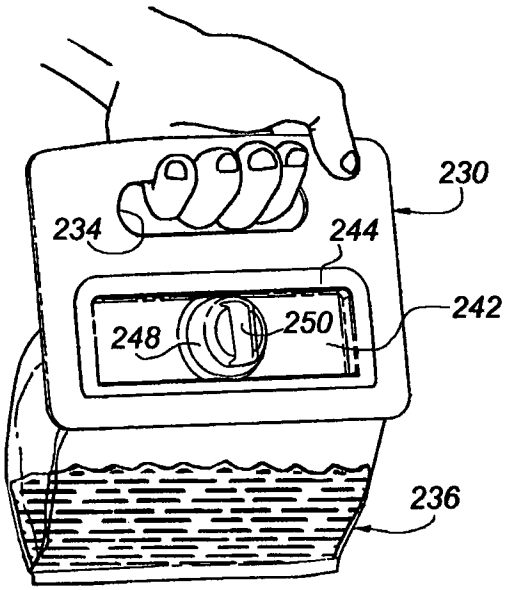
FIG. 53 is a front perspective view showing components of the system of FIGS. 48 through 52 being carried for disposal of contained matter.

As shown in FIG. 50, the clearing tool 238, 240 is of course employed to clear away the unwanted matter, with the integral squeegee element 246 of the head member 238 wiping the soiled or contaminated surface. The bottom marginal portion of the front panel 230 provides an integral ramp section for guiding the matter into the aperture 232 and through the mouth 237 of the receptacle 236. After disengagement of the handle 240, the entire remaining assembly, containing the cleared matter, may be taken for disposal, as depicted in FIG. 53. It will be appreciated that an inexpensive handle (such as may be made from tubular cardboard or a cheap plastic extrusion) may be permanently (or disengageably) attached to the head member, to make complete disposal of the clearing practical from an economic standpoint.

Figure 59:
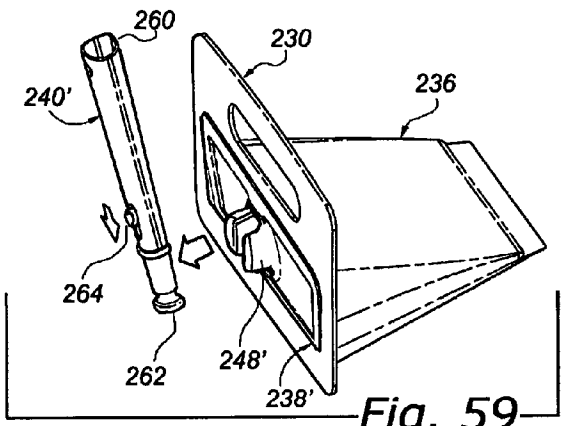
FIG. 59 is a perspective view of the system of FIGS. 57 and 58, showing the handle removed from the head member.

A more positive engagement of the handle and head member may however be provided by the incorporation of a mechanical engaging or locking feature, one suitable form of which is incorporated into the handle, generally designated by the numeral 240', as illustrated in FIG. 57 through 59. Rather than having a fixed knob at its bottom end, the handle 240' employs a bolt, generally designated by the numeral 258, which is slideably mounted within the bore 260 of the handle 240' and is comprised of a knob formation 262 at one end of a rod-like part 263, which protrudes from the handle bore 260, and a pin or button 264 which extends laterally from the part 263 through a slot 266; the bolt 258 is biased upwardly (into its engagement position) by an internal coil spring 268.

The engaged relationship of the bolt 258 with the boss 248' of the head member 238' is shown in FIG. 57, and the disengaged relationship is shown in FIGS. 58 and 59. As is evident, disengagement is achieved by applying downward force to the protruding button 264 so as to displace the knob formation 266 from the boss 248'. As can be seen in FIG. 58, the boss 248' is indented (circumferentially) at 270 for more positive receipt of the knob formation 266 and the spaced collar 256 and to increase the security of mechanical connection.

Figure 60:
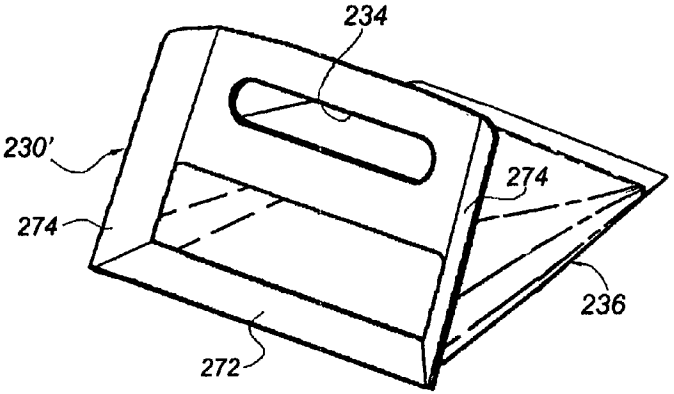
FIG. 60 is a perspective view showing an alternative form of the front structure employed in the containment unit of FIGS. 48 through 59.

Finally, a further modification to the system of FIGS. 48 through 59 is shown in FIG. 60. As can be seen, the bottom and lateral marginal portions 272, 274 of the front structure, generally designated by the numeral 230', are angled inwardly toward the plane of the central section 276. This configuration serves to funnel material into the receptacle bag during cleanup.

As will be appreciated by those of ordinary skill in the art, many modifications may be made to the cleanup system of the present invention without departure from the scope of the appended claims. The particular form, shape, and construction of the containment unit and clearing component, and of the parts thereof, may vary widely from those that are illustrated and specifically described herein, and suitable materials of construction (normally of polymeric nature), other than those mentioned, will be evident based upon the present disclosure.

It should be emphasized that references herein to "closing" and "closure of" the entrance and top opening to a containment unit or receptacle (and use of forms of that terminology) mean that the cooperating parts, components, and elements mate sufficiently with one another (directly, or with an interposed gasket or the like) so as to leave no significant spaces or gaps through which a substantial amount of the contained matter can leak or escape, and that the tightness of the optimal fit may depend upon the nature of the matter, being solid, semi-liquid or liquid, toxic or benign, etc. The ultimate level of closure will in general produce a sealed, liquid-tight relationship.

Thus, it can be seen that the present invention provides a novel cleanup system with which liquid, semi-liquid, and/or dry matter can be moved from a surface into a receptacle and readily maintained therein without escape, undue leakage, or spillage. More specifically, a clearing component (e.g., a squeegee tool) is engageable with a cooperating receptacle component for closing the access opening through which the removed matter passes into a chamber of the receptacle, as well as a top opening, so as to prevent such escape, leakage, or spillage and, in preferred embodiments, for effectively sealing the openings. The system is of relatively incomplex and inexpensive construction, is easy and convenient to use and store, and is highly effective for its intended purposes.

Having thus described the invention, what is claimed is:

1. A cleanup system comprised of a containment unit and a separate clearing component; said containment unit having a chamber for containing matter, handle structure disposed rearwardly of said chamber, and structure defining a top opening into said chamber and a contiguous front entrance to said chamber; said clearing component including closure structure comprised of at least one forward marginal portion extending laterally, from side-to-side on said clearing component and having a surface-clearing element thereon and a plate portion extending rearwardly from said marginal portion, and handle structure disposed rearwardly of said plate portion and being dimensioned and configured to mate with said handle structure of said containment unit; said containment unit and said clearing component having means thereon for securing said containment unit and said clearing component in an interengaged, closed relationship in which said closure structure of said clearing component overlies said top opening and said front entrance of said containment unit, said closure structure being dimensioned and configured to substantially span and thereby close said top opening and said entrance, in said overlying position, against the substantial escape of matter therethrough from said interior chamber; said means for securing comprising pivotably interengageable elements forwardly disposed on said containment unit and said clearing component and permitting pivotal movement of said clearing component to said closed relationship, and fixedly interengageable elements rearwardly disposed on said containment unit and said clearing component for disengageably maintaining said containment unit and said clearing component in said closed relationship.

2. The system of claim 1 wherein said forwardly disposed pivotably interengageable elements comprising said means for securing comprise two laterally-spaced and aligned recess-defining structures and two laterally spaced and aligned insert elements the recesses defined by said recess-defining structures being dimensioned and configured for pivotably receiving said insert elements therein.

3. The system of claim 2 wherein said containment unit includes an upstanding wall defining said top opening, wherein said plate portion of said clearing component has a peripheral marginal portion thereon extending generally rearwardly from adjacent said at least one forward marginal portion, and wherein said pivotably interengageable elements are disposed on said upstanding wall and on or proximate said forward marginal portion.

4. The system of claim 3 wherein said two recess-defining structures are both on said upstanding wall of said containment unit, and wherein said two insert elements are both on or proximate said forward marginal portion of said clearing component.

5. The system of claim 4 wherein said recesses defined by said two recess-defining structures open forwardly to receive said insert elements inserted in the rearward direction.

6. The system of claim 4 wherein said recesses defined by said two recess-defining structures open rearwardly to receive said insert elements inserted in the forward direction.

7. The system of claim 1 wherein said forwardly disposed pivotably interengageable elements comprising said means for securing comprise a laterally extending edge element and structure defining at least one laterally extending groove, the groove defined by said structure defining said at least one laterally extending groove being dimensioned and configured for pivotably receiving said laterally extending edge element.

8. The system of claim 7 wherein said containment unit additionally includes ramp structure leading to said chamber thereof, wherein said clearing component additionally includes a squeegee member extending along said forward marginal portion thereof, and wherein said pivotably interengageable elements are disposed on said ramp structure and said squeegee member.

9. The system of claim 8 wherein said edge element is on said ramp structure and said groove-defining structure is on said squeegee member.

10. The system of claim 3 wherein said two insert elements are both on said upstanding wall of said containment unit, and wherein said two recess-defining insert elements are both on or proximate said forward marginal portion of said clearing component.

11. The system of claim 1 additionally including at least one gasket element interposed between surfaces on said containment unit and said clearing component that mate in said closed relationship of said closure structure of said clearing component and said containment unit.

12. The system of claim 1 wherein said handle structures of said containment unit and said clearing component extend rearwardly.

13. The system of claim 1 wherein said fixedly interengageable elements comprise coacting detent elements disposed adjacent forward ends of said handle structures.

14. The system of claim 1 wherein said clearing component additionally includes a squeegee member extending laterally along said at least one forward marginal portion, said squeegee member having at opposite ends thereof lateral edges and declining forwardly from said at least one forward marginal portion of said clearing component to a surface-engaging leading edge, said squeegee member having generally triangular matter-confinement flaps joined to and depending from said lateral edges of said squeegee member and extending to said leading edge thereof, and having a free, surface-engaging lower edge extending rearwardly from said leading edge, each of said matter-confinement flaps being pleated along at least one line extending rearwardly from said leading edge of said squeegee member and intermediate said lower edge thereof and said joined lateral edge of said squeegee member, and said each matter-confinement flap being constructed to fold inwardly naturally, on a pleat thereof, in response to force effectively applied upwardly to said lower edge thereof.

15. The cleanup system of claim 1 wherein said containment unit comprises a rigid body defining said chamber, and wherein said clearing component is a tool having a head member comprising said closure structure.

16. The cleanup system of claim 1 wherein said surface-clearing element is a squeegee element or a brush element.

17. The cleanup system of claim 1 wherein said head member of said tool has opposite, substantially parallel marginal portions extending thereacross, each of said marginal portions having a said surface-clearing element thereon, one of said surface-clearing elements being a squeegee element and the other of said surface-clearing elements being a brush element.

18. The cleanup system of claim 1 wherein said, entrance-defining structure includes a ramp portion leading to said entrance to said chamber.

* * * * *